US012359369B2

(12) United States Patent
Chen

(10) Patent No.: US 12,359,369 B2
(45) Date of Patent: Jul. 15, 2025

(54) SKIN PROTECTION AGAINST MICROBIAL PARTICLES

(71) Applicant: Singletto Inc., Seattle, WA (US)

(72) Inventor: James Chongchu Chen, Clyde Hill, WA (US)

(73) Assignee: Singletto Inc., Seattle, WA (US)

( * ) Notice: Subject to any disclaimer, the term of this patent is extended or adjusted under 35 U.S.C. 154(b) by 0 days.

(21) Appl. No.: 18/231,922

(22) Filed: Aug. 9, 2023

(65) Prior Publication Data

US 2024/0052560 A1 Feb. 15, 2024

Related U.S. Application Data

(60) Provisional application No. 63/525,312, filed on Jul. 6, 2023, provisional application No. 63/523,596, filed on Jun. 27, 2023, provisional application No. 63/463,437, filed on May 2, 2023, provisional application No. 63/441,139, filed on Jan. 25, 2023, provisional application No. 63/398,796, filed on Aug. 17, 2022, provisional application No. 63/397,321, filed on Aug. 11, 2022.

(51) Int. Cl.

| | |
|---|---|
| ***D06M 13/355*** | (2006.01) |
| ***D06M 11/74*** | (2006.01) |
| ***D06M 13/00*** | (2006.01) |
| ***D06M 16/00*** | (2006.01) |

(52) U.S. Cl.

CPC ..... *D06M 13/355* (2013.01); *D06M 11/74* (2013.01); *D06M 13/005* (2013.01); *D06M 16/00* (2013.01); *D06M 2200/12* (2013.01); *D06M 2200/25* (2013.01)

(58) Field of Classification Search

None

See application file for complete search history.

(56) References Cited

U.S. PATENT DOCUMENTS

| | | | |
|---|---|---|---|
| 2,547,825 | A | 4/1951 | King |
| 2,637,887 | A | 5/1953 | Goodman et al. |

(Continued)

FOREIGN PATENT DOCUMENTS

| | | | |
|---|---|---|---|
| AU | 2006341380 | B2 | 1/2013 |
| AU | 2013202001 | A1 | 4/2013 |

(Continued)

OTHER PUBLICATIONS

International Preliminary Report on Patentability Chapter I for International Patent Application No. PCT/US2021/058678 mailed May 25, 2023, 6 Pages.

(Continued)

*Primary Examiner* — Arti Singh-Pandey

(74) *Attorney, Agent, or Firm* — John W. Branch; Branch Partners PLLC

(57) ABSTRACT

A method of manufacture and a fabric product that includes a concentrated formulation of photosensitizers having anti-microbial properties that are applied to outer surfaces of the fabric product. The inner surfaces of the fabric product are configured as a protective barrier for a user of the fabric product. Light activation of the photosensitizers protects the user against a range of pathogens, toxins, poisons, microbial particles and radiation particles incident on the outer surfaces of the fabric product.

10 Claims, 15 Drawing Sheets

(56) References Cited

U.S. PATENT DOCUMENTS 3,674,486 A 7/1972 Milgrom
3,817,389 A 6/1974 Weichselbaum
4,059,852 A 11/1977 Crane
4,089,065 A 5/1978 McGee
4,324,005 A 4/1982 Willis
4,382,079 A 5/1983 Marschner
4,395,789 A 8/1983 Bruce
4,402,318 A 9/1983 Swartz
4,685,151 A 8/1987 Kincheloe
4,775,348 A 10/1988 Collins
5,344,051 A 9/1994 Brown
5,366,402 A 11/1994 Rudell et al.
5,445,608 A 8/1995 Chen et al.
5,526,957 A 6/1996 Brown et al.
5,534,346 A 7/1996 Robinson
5,569,477 A 10/1996 Nesbitt
5,715,837 A 2/1998 Chen
5,741,316 A 4/1998 Chen et al.
5,766,234 A 6/1998 Chen et al.
5,782,896 A 7/1998 Chen et al.
5,814,008 A 9/1998 Chen et al.
5,827,186 A 10/1998 Chen et al.
5,830,526 A 11/1998 Wilson et al.
5,865,840 A 2/1999 Chen
5,891,062 A 4/1999 Schock et al.
5,997,569 A 12/1999 Chen et al.
6,004,510 A 12/1999 Gilbert et al.
6,080,160 A 6/2000 Chen et al.
6,096,066 A 8/2000 Chen et al.
6,210,425 B1 4/2001 Chen
6,238,426 B1 5/2001 Chen
6,273,904 B1 8/2001 Chen et al.
6,281,611 B1 8/2001 Chen et al.
6,317,691 B1 11/2001 Narayan et al.
6,319,273 B1 11/2001 Chen et al.
6,331,744 B1 12/2001 Chen et al.
6,344,050 B1 2/2002 Chen
6,351,854 B1 3/2002 Whalen et al.
6,416,531 B2 7/2002 Chen
6,420,455 B1 7/2002 Landgrebe et al.
6,443,978 B1 9/2002 Zharov
6,454,789 B1 9/2002 Chen et al.
6,520,669 B1 2/2003 Chen et al.
6,572,839 B2 6/2003 Sugita et al.
6,580,228 B1 6/2003 Chen et al.
6,606,767 B2 8/2003 Wong
6,635,267 B1 10/2003 Miyoshi et al.
6,691,898 B2 2/2004 Hurray et al.
6,692,694 B1 2/2004 Curry et al.
6,846,305 B2 1/2005 Smith et al.
6,860,782 B2 3/2005 Hornsby et al.
7,018,395 B2 3/2006 Chen
7,087,219 B2 8/2006 Burzynski et al.
7,211,056 B2 5/2007 Petelenz et al.
7,288,106 B2 10/2007 Heacock et al.
7,320,158 B2 1/2008 Deto et al.
7,320,786 B2 1/2008 Chen
7,511,031 B2 3/2009 Chen
7,611,033 B2 11/2009 Ganzeboom
7,774,867 B2 8/2010 Orita et al.
7,802,572 B2 9/2010 Hahne
RE42,610 E 8/2011 Schramm
8,057,464 B2 11/2011 Chen et al.
8,226,946 B2 7/2012 Chen
8,283,135 B2 10/2012 Doyle et al.
8,293,802 B2 10/2012 Modak et al.
8,365,316 B2 2/2013 Jan et al.
8,402,568 B2 3/2013 Alstin et al.
8,439,674 B2 5/2013 Li et al.
8,450,359 B2 5/2013 McCoy et al.
8,484,809 B2 7/2013 Fiedler
8,545,120 B2 10/2013 Breidenbach et al.
8,616,414 B2 12/2013 Ciavarella
8,685,005 B2 4/2014 Dahm et al.
8,685,071 B2 4/2014 Burwell et al.
8,759,092 B2 6/2014 Goodrich
8,956,379 B2 2/2015 Luciano et al.
9,073,066 B2 7/2015 Banks et al.
9,080,976 B2 7/2015 Hackbarth et al.
9,114,971 B2 8/2015 Rasmussen et al.
9,140,030 B2 9/2015 Jin
9,149,651 B2 10/2015 Keltner et al.
9,167,880 B2 10/2015 Wilson et al.
9,278,148 B2 3/2016 Fewkes et al.
9,352,074 B2 5/2016 Gros
9,480,760 B2 11/2016 Appeaning et al.
9,527,918 B2 12/2016 Fiori et al.
9,662,258 B2 5/2017 Slattery, Jr. et al.
9,775,389 B2 10/2017 Azzolin et al.
9,931,656 B2 4/2018 Gonzalez et al.
10,105,386 B2 10/2018 Vehige et al.
10,175,687 B2 1/2019 Lema et al.
10,307,610 B2 6/2019 Keltner et al.
10,327,444 B2 6/2019 Topchik
10,666,928 B2 5/2020 Liu
10,786,592 B2 9/2020 Keith
11,458,220 B2 10/2022 Chen et al.
11,925,717 B2 3/2024 Chen et al.
2002/0069777 A1 6/2002 Rossini et al.
2002/0088825 A1 7/2002 Laverdure
2003/0035750 A1 2/2003 Neuberger
2003/0114434 A1 6/2003 Chen et al.
2004/0170526 A1 9/2004 Curry et al.
2006/0223729 A1 10/2006 Hamblin et al.
2007/0038204 A1 2/2007 Chen et al.
2007/0059316 A1 3/2007 Pallenberg et al.
2007/0059791 A1 3/2007 Goodrich
2007/0129776 A1 6/2007 Robins et al.
2007/0133935 A1 6/2007 Fine
2007/0142880 A1 6/2007 Barnard et al.
2007/0286878 A1 12/2007 Harruna
2008/0015189 A1 1/2008 Hamblin et al.
2008/0030010 A1 2/2008 Millet Lopez
2008/0051736 A1 2/2008 Rioux et al.
2008/0107636 A1 5/2008 Goodrich et al.
2008/0172779 A1 7/2008 Ferguson
2008/0243383 A1 10/2008 Lin
2009/0317293 A1 12/2009 Street et al.
2009/0317436 A1 12/2009 Wilson et al.
2010/0129267 A1 5/2010 Akutsu et al.
2010/0174223 A1 7/2010 Sakamoto et al.
2010/0241054 A1 9/2010 Dacey, Jr. et al.
2010/0261798 A1 10/2010 Neuss et al.
2010/0274330 A1 10/2010 Burwell et al.
2010/0305436 A1 12/2010 Chen et al.
2010/0313890 A1 12/2010 Messier
2011/0008372 A1 1/2011 Chen
2011/0009464 A1 1/2011 Chen
2011/0014239 A1 1/2011 Goodrich
2011/0093003 A1 4/2011 Lee
2011/0110818 A1 5/2011 Mowbray-d'Arbela et al.
2011/0152219 A1 6/2011 Stagni et al.
2012/0100039 A1 4/2012 Appeaning et al.
2012/0209359 A1 8/2012 Chen et al.
2013/0060172 A1 3/2013 Palazzolo et al.
2013/0251440 A1 9/2013 Young et al.
2013/0289457 A1 10/2013 Young et al.
2014/0052050 A1 2/2014 Courtin
2014/0076404 A1 3/2014 Tan et al.
2014/0303547 A1 10/2014 Loupis et al.
2015/0202608 A1 7/2015 Masaoka et al.
2015/0231287 A1 8/2015 Lin et al.
2015/0313608 A1 11/2015 Baudenbacher et al.
2016/0091399 A1 3/2016 Chen et al.
2016/0193338 A1 7/2016 Loupis et al.
2016/0220728 A1 8/2016 Adams et al.
2016/0270472 A1 9/2016 Allen et al.
2016/0270895 A1 9/2016 Zoll et al.
2016/0310758 A1 10/2016 Friedman et al.
2016/0358485 A1 12/2016 Sommer et al.
2017/0056603 A1 3/2017 Cowan et al.
2017/0202279 A1 7/2017 Mazzarolo et al.
2018/0099063 A1 4/2018 Lyons et al.
2018/0160720 A1 6/2018 Von Hasseln

(56) References Cited

U.S. PATENT DOCUMENTS

| | | | |
|---|---|---|---|
| 2018/0214552 | A1 | 8/2018 | Sul et al. |
| 2018/0243790 | A1 | 8/2018 | Grossman et al. |
| 2019/0161562 | A1 | 5/2019 | Bakar et al. |
| 2019/0192719 | A1 | 6/2019 | Drayton et al. |
| 2019/0209857 | A1 | 7/2019 | Brawn et al. |
| 2019/0314502 | A1 | 10/2019 | Wei et al. |
| 2020/0289985 | A1 | 9/2020 | Drake et al. |
| 2020/0315280 | A1 | 10/2020 | Kaye |
| 2021/0346531 | A1 | 11/2021 | Kim et al. |
| 2022/0054149 | A1 | 2/2022 | Chen et al. |
| 2022/0054667 | A1 | 2/2022 | Chen et al. |
| 2022/0054672 | A1 | 2/2022 | Chen et al. |
| 2022/0061318 | A1 | 3/2022 | Chen et al. |
| 2022/0062461 | A1 | 3/2022 | Chen et al. |
| 2022/0096703 | A1 | 3/2022 | Chen et al. |
| 2022/0143243 | A1 | 5/2022 | Chen et al. |
| 2022/0226530 | A1 | 7/2022 | Suetsugu |
| 2023/0035662 | A1 | 2/2023 | Chen et al. |
| 2023/0165988 | A1 | 6/2023 | Chen et al. |
| 2023/0390430 | A1 | 12/2023 | Chen |
| 2024/0123108 | A1 | 4/2024 | Chen |

FOREIGN PATENT DOCUMENTS

| | | | | |
|---|---|---|---|---|
| AU | 2015200474 | B2 | 2/2015 | |
| AU | 2016235771 | B2 | 9/2016 | |
| AU | 2016235788 | A1 | 9/2016 | |
| CA | 2276023 | C | 4/2002 | |
| CA | 2428099 | C | 6/2002 | |
| CA | 2473924 | A1 | 7/2003 | |
| CA | 2537235 | A1 | 1/2005 | |
| CA | 2733752 | C | 1/2014 | |
| CA | 2693491 | C | 10/2014 | |
| CN | 102115951 | B | 7/2012 | |
| CN | 101479438 | B | 5/2014 | |
| CN | 104138310 | A | 11/2014 | |
| CN | 205094776 | U | 3/2016 | |
| CN | 104589717 | B | 3/2017 | |
| CN | 208597758 | U | 3/2019 | |
| CN | 107353723 | B | 5/2020 | |
| EP | 1644082 | A2 | 4/2006 | |
| EP | 1684865 | A1 | 8/2006 | |
| EP | 2181691 | A1 | 5/2010 | |
| EP | 1429993 | B1 | 1/2011 | |
| EP | 1940907 | B1 | 4/2011 | |
| EP | 2428461 | B1 | 4/2013 | |
| GB | 2374856 | A | 10/2002 | |
| GB | 2482745 | A | 2/2012 | |
| JP | 2004-275927 | A | 10/2004 | |
| JP | 2005-009065 | A | 1/2005 | |
| JP | 2005506938 | A | 3/2005 | |
| JP | 2005-112791 | A | 4/2005 | |
| JP | 4238174 | B2 | 3/2009 | |
| JP | 4536377 | B2 | 9/2010 | |
| JP | 2014-004329 | A | 1/2014 | |
| JP | 5632478 | B2 | 11/2014 | |
| JP | 2015-159819 | A | 9/2015 | |
| KR | 200348162 | Y1 | 5/2004 | |
| KR | 100822777 | B1 | 4/2008 | |
| KR | 10-2014-0028671 | A | 3/2014 | |
| KR | 20170076342 | A | 7/2017 | |
| KR | 20170082259 | A | 7/2017 | |
| PL | 230175 | B1 | 9/2018 | |
| RU | 2397127 | C2 | 8/2010 | |
| TW | I610806 | B | 1/2018 | |
| WO | 98/32494 | A1 | 7/1998 | |
| WO | 1999018924 | A1 | 4/1999 | |
| WO | WO-9949823 | A1 * | 10/1999 | ..... A01N 25/10 |
| WO | 2000004930 | A2 | 2/2000 | |
| WO | 2004108249 | A1 | 12/2004 | |
| WO | 2005/004704 | A2 | 1/2005 | |
| WO | 2005/037372 | A1 | 4/2005 | |
| WO | 2005032459 | A2 | 4/2005 | |
| WO | 2006086770 | A2 | 8/2006 | |
| WO | 2007103781 | A2 | 9/2007 | |
| WO | 2008044222 | A2 | 4/2008 | |
| WO | 2008046019 | A1 | 4/2008 | |
| WO | 2009132223 | A1 | 10/2009 | |
| WO | 2010076658 | A2 | 7/2010 | |
| WO | 2014057116 | A1 | 4/2014 | |
| WO | 2014130740 | A1 | 8/2014 | |
| WO | 2016039812 | A1 | 3/2016 | |
| WO | 2016/153910 | A1 | 9/2016 | |
| WO | 2018022926 | A1 | 2/2018 | |
| WO | 2018151236 | A1 | 8/2018 | |
| WO | 2019183320 | A1 | 9/2019 | |
| WO | 2021001441 | A1 | 1/2021 | |
| WO | 2021001445 | A1 | 1/2021 | |
| WO | 2022/103775 | A1 | 5/2022 | |

OTHER PUBLICATIONS

Office Communication for U.S. Appl. No. 17/522,811 mailed Jan. 27, 2022, 10 Pages.

Office Communication for U.S. Appl. No. 17/958,639 mailed Jan. 6, 2023, 6 Pages.

Office Communication for U.S. Appl. No. 18/100,993 mailed Oct. 11, 2023, 12 Pages.

Office Communication for U.S. Appl. No. 17/958,639 mailed Nov. 8, 2023, 10 Pages.

Office Communication for U.S. Appl. No. 18/205,082 mailed Nov. 8, 2023, 14 Pages.

Office Communication for U.S. Appl. No. 18/100,993 mailed Dec. 21, 2023, 4 Pages.

Office Communication for U.S. Appl. No. 18/379,863 mailed Dec. 13, 2023, 6 Pages.

Kim, Michele M. et al., "Light Sources and Dosimetry Techniques for Photodynamic Therapy," Photochemistry and Photobiology, 2020, vol. 96, pp. 280-294.

Menichini, Federica et al., "In vitro photo-induced cytotoxic activity of Citrus bergamia and *C. medica* L. cv. Diamante peel essential oils and identified active coumarins," Pharmaceutical Biology, vol. 48, No. 9, pp. 1059-1065.

Yu. Jing et al., "Green preparation of carbon dots by Jinhua bergamot for sensitive and selective fluorescent detection of Hg2+ and Fe3+," Sensors and Actuators B: Chemical, 2015, vol. 214, pp. 29-35.

Akasov, Roman A. et al., "Photodynamic therapy of melanoma by blue-light photoactivation of flavin mononucleotide," Scientific Reports, 2019, vol. 9, Article No. 9679, pp. 1-11.

Sigma-Aldrich, "Hyaluronic acid sodium salt," https://www.sigmaaldrich.com/US/en/product/sigma/h5542, Accessed: Nov. 22, 2021, pp. 1-5.

Alven, Sibusiso et al., "Hyaluronic Acid-Based Scaffolds as Potential Bioactive Wound Dressings," Polymers, 2021 vol. 13, No. 2102, pp. 1-20.

RadiologyInfo, "Intravascular Ultrasound," https://www.radiologyinfo.org/en/info/ultrasound-intravascular, Accessed: Nov. 22, 2021, pp. 1-6.

Malewar, Amit, "Tengujo, the world's thinnest paper, almost completely transparent," Inceptive Mind, https://www.inceptivemind.com/tengujo-worlds-thinnest-paper-nearly-transparent/13273/, Accessed: Nov. 15, 2021, pp. 1-5.

Nakonechny, Faina et al., "Aspects of Photodynamic Inactivation of Bacteria," Microorganisms, 2020, Chapter 7, pp. 131-151.

Mesquita, Mariana Q. et al., "Revisiting Current Photoactive Materials for Antimicrobial Photodynamic Therapy," Molecules, 2018, vol. 23, No. 2424, pp. 1-47.

Seghatchian, Jerard et al., "Main Properties of the THERAFLEX MB-Plasma System for Pathogen Reduction," Transfusion Medicine and Hemotherapy, 2011, vol. 38, No. 1, pp. 55-64.

Eickmann, Markus et al., "Inactivation of Ebola virus and Middle East respiratory syndrome coronavirus in platelet concentrates and plasma by ultraviolet C light and methylene blue plus visible light, respectively," Transfusion, 2018, vol. 58, pp. 2202-2207.

Shang, Ke et al., "Accelerated In Vitro Degradation of Optically Clear Low β-Sheet Silk Films by Enzyme-Mediated Pretreatment," Translational Vision Science & Technology, vol. 2, No. 3, Article 2, pp. 1-11.

(56) References Cited

OTHER PUBLICATIONS

Evonik, "A Broad Range of Standard, Custom and Specialized Biodegradable Polymers for Medical Applications," https://healthcare.evonik.com/en/medical-devices/biodegradable-materials/resomer-portfolio, Accessed: Nov. 22, 2021, pp. 1-3.
Hidakawashi Co., Ltd., "Japanese Paper TENGU," https://www.hidakawashi.com/paper-TENGU/index.html, Accessed: Nov. 15, 2021, pp. 1-2.
Yang, Wenjing et al., "3D Printing of Polymeric Multi-Layer Micro-Perforated Panels for Tunable Wideband Sound Absorption," Polymers, 2020, vol. 12, No. 360, pp. 1-17.
Bazaz, Sajad Razavi et al., "3D Printing of Inertial Microfluidic Devices," Scientific Reports, 2020, vol. 10, Article No. 5929, pp. 1-14.
Waheed, Sidra et al., "3D printed microfluidic devices: enablers and barriers," The Royal Society of Chemistry, Lab Chip, 2016, vol. 16, Iss. 11, pp. 1-21.
CDC—The National Institute for Occupational Safety and Health (NIOSH), https://www.cdc.gov/niosh/index.htm, Accessed: Nov. 15, 2021, p. 1.
Shirata, Chikara et al., "Near-infrared photothermal/photodynamic therapy with indocyanine green induces apoptosis of hepatocellular carcinoma cells through oxidative stress," Scientific Reports, vol. 7, Article No. 13958, pp. 1-8.
Dias, Lucas D. et al., "COVID-19: Beyond the virus. The use of photodynamic therapy for the treatment of infections in the respiratory tract," Photodiagnosis and Photodynamic Therapy, Letter to the Editor, 2020, vol. 31, pp. 1-2.
Kim, Jaesung et al., "Photosensitized Production of Singlet Oxygen via C60 Fullerene Covalently Attached to Functionalized Silica-coated Stainless-Steel Mesh: Remote Bacterial and Viral Inactivation," Applied Catalysts B: Environmental, 2020, vol. 270, Article No. 118862, pp. 1-9.
Hasegawa, Keisuke et al., "Curved acceleration path of ultrasound-driven air flow," Journal of Applied Physics, vol. 125, Article No. 054902, pp. 1-6.
Sunday, Michael Oluwatoyin et al., "A simple, inexpensive method for gas-phase singlet oxygen generation from sensitizer-impregnated filters: Potential application to bacteria/virus inactivation and pollutant degradation," Science of the Total Environment, 2020, vol. 746, Article No. 141186, pp. 1-6.
Komaiko, Jennifer S. et al., "Formation of Food-Grade Nanoemulsions Using Low-Energy Preparation Methods: A Review of Available Methods," Comprehensive Reviews in Food Science and Food Safety, 2016, vol. 15, pp. 331-352.
Chemistry Industry, "Emulsifiers," https://www.chemistryindustry.biz/emulsifiers.html, Accessed: Nov. 15, 2021, pp. 1-9.
Smartblend, "Cocktail foams, airs and bubbles—How to make them," https://www.smartblend.co.uk/blog/cocktail-foams-airs-and-bubbles-and-how-to-make-them, Accessed: Dec. 6, 2021, pp. 1-16.
Kitchen Theory, "Lecithin & Culinary Foam," https://kitchen-theory.com/culinary-foam/, Accessed: Nov. 15, 2021, pp. 1-4.
Hillary, Sarah L. et al., "Use of methylene blue and near-infrared fluorescence in thyroid and parathyroid surgery." Langenbeck's Archives of Surgery, 2018, vol. 403, pp. 111-118.
Alander, Jarmo T. et al., "A Review of Indocyanine Green Fluorescent Imaging in Surgery," International Journal of Biomedical Imaging, 2012, vol. 2012, pp. 1-26.
Verma, Siddhartha et al., "Visualizing the effectiveness of face masks in obstructing respiratory jets," Physics of Fluids, 2020, vol. 32, pp. 1-7.
Instructables Living, "Bubble Machine," https://www.instructables.com/Bubble-Machine/, Accessed: Nov. 30, 2021, pp. 1-6.
Divangahi, Maziar et al., "Trained immunity, tolerance, priming and differentiation: distinct immunological processes," Nature Immunology, 2021, vol. 22, pp. 2-6.
Kumar, Sandeep et al., "Sensing Molecules with Metal-Organic Framework Functionalized Graphene Transistors," Advanced Materials, 2021, vol. 33, Article No. 2103316, pp. 1-12.
Wang, Ying et al., "Choosing optimal wavelength for photodynamic therapy of port wine stains by mathematic simulation," Journal of Biomedical Optics, 2011, vol. 16, No. 9, pp. 1-9.
Ursa BioScience, "Singlet Oxygen Sensitizers," https://ursabioscience.com/technology/singlet-oxygen-sensitizer, Accessed: Mar. 2, 2021, pp. 1-6.
Naito, Kazuya et al., "Single-molecule detection of airborne singlet oxygen," Journal of the American Chemical Society, 2006, vol. 128, No. 51, pp. 16430-16431.
Zhao, Yuanyuan et al., "Singlet oxygen generation on porous superhydrophobic surfaces: effect of gas flow and sensitizer wetting on trapping efficiency," The Journal of Physical Chemistry A, 2014, vol. 118, No. 45, pp. 10364-10371.
Gao, Rui et al., "Nano-photosensitizer based on layered double hydroxide and isophthalic acid for singlet oxygenation and photodynamic therapy," Nature Communications, 2018, vol. 9, No. 1, pp. 1-10.
Felgenträger, Ariane et al., "Singlet oxygen generation in porphyrin-doped polymeric surface coating enables antimicrobial effects on *Staphylococcus aureus*," Physical Chemistry Chemical Physics: PCCP, 2014, vol. 16, No. 38, pp. 20598-20607.
Pushalkar, Smruti et al., "Superhydrophobic Photosensitizers: Airborne 1O2 Killing of an in Vitro Oral Biofilm at the Plastron Interface," ACS Applied Materials & Interfaces, 2018, vol. 10, No. 30, pp. 25819-25829.
Hwang, Jeong-Wook et al., "Study of Singlet Oxygen Dynamics on Silicon Polymer Matrix," Journal of Analytical Methods in Chemistry, 2019, vol. 2019, pp. 1-6.
Bartusik, Dorota et al., "Bacterial Inactivation by a Singlet Oxygen Bubbler: Identifying Factors Controlling the Toxicity of 1O2 Bubbles," Environmental Science & Technology, 2012, vol. 46, No. 21, pp. 12098-12104.
Aebisher, David et al., "Superhydrophobic Surfaces as a Source of Airborne Singlet Oxygen through Free Space for Photodynamic Therapy," ACS Applied Bio Materials, 2020, vol. 3, No. 4, pp. 2370-2377.
Weaver, Eric A., "Dose Effects of Recombinant Adenovirus Immunization in Rodents," Vaccines, 2019, vol. 7, No. 4:144, pp. 1-11.
Borkar, Tanhai G. et al., "Techniques Employed in Production of Traditional Vaccines Commonly Used by Military Forces: A Review," Journal of Archives in Military Medicine, 2019, vol. 7, No. 1-2, pp. 1-12.
Hankaniemi, Minna M. et al., "A comparative study of the effect of UV and formalin inactivation on the stability and immunogenicity of a Coxsackievrius B1 vaccine," Vaccine, 2019, vol. 37, Iss. 40, pp. 5962-5971.
Mills, Devin et al., "Ultraviolet germicidal irradiation of influenza-contaminated N95 filtering facepiece respirators," American Journal of Infection Control, 2018, vol. 46, Iss. 7, pp. e49-e55.
Bull, James J. et al., "Transmissible Viral Vaccines," Trends in Microbiology, 2018, vol. 26, No. 1, pp. 6-15.
Barrett, P. Noel et al., "Vero cell technology for rapid development of inactivated whole virus vaccines for emerging viral diseases," Expert Review of Vaccines, 2017, vol. 16, Iss. 9, pp. 883-894.
Klausberger, Miriam et al., "One-shot vaccination with an insect cell-derived low-dose influenza A H7 virus-like particle preparation protects mice against H7N9 challenge," Vaccine, 2014, vol. 32, Iss. 3, pp. 355-362.
Mertes, Paul M. et al., "Methylene blue-treated plasma: An increased allergy risk?," The Journal of Allergy and Clinical Immunology, Letters to the Editor, 2012, vol. 130, Iss. 3, pp. 808-812.
Marcus, Philip I. et al., "In Vitro Analysis of Virus Particle Subpopulations in Candidate Live-Attenuated Influenza Vaccines Distinguishes Effective from Ineffective Vaccines," Journal of Virology, 2010, vol. 84, No. 21, pp. 10974-10981.
Quan, Fu-Shi et al., "Dose sparing enabled by skin immunization with influenza virus-like particle vaccine using microneedles," Journal of Controlled Release, 2010, vol. 147, Iss. 3, pp. 326-332.
Victoria, Joseph G. et al., "Viral Nucleic Acids in Live-Attenuated Vaccines: Detection of Minority Variants and an Adventitious Virus," Journal of Virology, 2010, vol. 84, No. 12, pp. 6033-6040.

(56) References Cited

OTHER PUBLICATIONS

Maves, Ryan C. et al., "Immunogenicity of a Psoralen-Inactivated Dengue Virus Type 1 Vaccine Candidate in Mice," Clinical and Vaccine Immunology, 2010, vol. 17, No. 2, pp. 304-306.
Geeraedts, Felix et al., "Superior Immunogenicity of Inactivated Whole Virus H5N1 Influenza Vaccine is Primarily Controlled by Toll-like Receptor Signalling," PLoS Pathogens, 2008, vol. 4, Iss. 8, pp. 1-8.
Monath, Thomas P. et al., "A live, attenuated recombinant West Nile virus vaccine," Proceedings of the National Academy of Sciences, 2006, vol. 103, No. 17, pp. 6694-6699.
Meurice, François et al., "Immunogenicity and Safety of a Live Attenuated Varicella Vaccine (Oka/SB Bio) in Healthy Children," The Journal of Infectious Diseases, 1996, vol. 174, Supplement 3, pp. S324-S329.
Cytiva, "Influenza vaccine manufacturing." https://www.cytivalifesciences.com/en/us/solutions/bioprocessing/knowledge-center/influenza-vaccine-manufacturing/, Accessed: Jun. 30, 2021, pp. 1-10.
Müller-Breitkreutz, Konstanze et al., "Inactivation of viruses by chemically and photochemically generated singlet molecular oxygen," Journal of Photochemistry & Photobiology B: Biology, 1995, vol. 30, Iss. 1, pp. 63-70.
Fernandez, Jim M. et al., "Singlet oxygen generation by photodynamic agents," Journal of Photochemistry & Photobiology B: Biology, 1997, vol. 37, pp. 131-140.
Rajesh, S. et al., "Antimicrobial photodynamic therapy: An overview," Journal of Indian Society of Periodontology, 2011, vol. 15, Iss. 4, pp. 323-327.
Kino, Katsuhito et al., "Commentary on the Phototoxicity and Absorption of Vitamin B2 and Its Degradation Product, Lumichrome," Pharmaceutica Analytica Acta, 2015, vol. 6, Iss. 8, pp. 1-3.
Makdoumi, Karim et al., "Different photodynamic effects of blue light with and without riboflavin on methicillin-resistant *Staphylococcus aureus* (MRSA) and human keratinocytes in vitro," Lasers in Medical Science, 2019, vol. 34, No. 9, pp. 1799-1805.
Wood, Simon et al., "Erythrosine is a potential photosensitizer for the photodynamic therapy of oral plaque biofilms," Journal of Antimicrobial Chemotherapy, 2006, vol. 57, Iss. 4, pp. 680-684.
Bhat, Manohara A. et al., "Effectiveness of erythrosine-mediated photodynamic antimicrobial chemotherapy on dental plaque aerobic microorganisms: A randomized controlled trial," Journal of Indian Society of Periodontology, 2017, vol. 21, Iss. 3, pp. 210-215.
Fecht, Sara, "The First Fully 3-D Printed LEDs Are Here," https://www.popsci.com/article/technology/first-fully-3-d-printed-leds-are-here/, 2014, Accessed: Jun. 30, 2021, pp. 1-4.
University of Southampton, "New Optical Fiber 3D Printing Technique," Optik & Photonik, 2015, vol. 10, Iss. 4, p. 17.
Molitch-Hou, Michael, "First 3D Printed Fiber Optics Created by University of Sydney Researchers with Desktop 3D Printer," 3D Printing Industry, https://3dprintingindustry.com/news/first-3d-printed-fiber-optics-createdby-university-of-sydney-researchers-with-desktop-3d-printer-55047/, 2015, Accessed: Jun. 30, 2021, p. 1.
Gahleitner, Markus et al., "Sterilization effects on polypropylene: Technology and polymer type effects," Tappi European Place Conference, 2003, pp. 1-7.
Ismail, Salim et al., "Efficacy of a Novel Light-Activated Antimicrobial Coating for Disinfecting Hospital Surfaces," Infection Control and Hospital Epidemiology, 2011, vol. 32, No. 11, pp. 1130-1132.
Piccirillo, C. et al., "Antimicrobial activity of methylene blue and toluidine blue O covalently bound to a modified silicone polymer surface," Journal of Materials Chemistry, 2009, vol. 19, Iss. 34, pp. 6167-6171.
Lee, Im-Soon et al., "Aerosol Particle Size Distribution and Genetic Characteristics of Aerosolized Influenza A H1N1 Virus Vaccine Particles," Aerosol and Air Quality Research, 2011, vol. 11, pp. 230-237.
Meyer, Michelle et al., "Aerosolized Ebola vaccine protects primates and elicits lung-resident T cell responses," The Journal of Clinical Investigation, 2015, vol. 125, No. 8, pp. 3241-3255.
Henneberry, Brittany, "How Surgical Masks are Made," Thomas Publishing Company, https://www.thomasnet.com/articles/other/how-surgical-masks-are-made/, Accessed: Jul. 1, 2021, pp. 1-6.
Omnexus: The material selection platform, "Clear Polypropylene (PP) for Transparent Polymer Applications," https://omnexus.specialchem.com/centers/clear-polypropylene/, Accessed: Jul. 1, 2021, p. 1.
Dancer, Stephanie J., "Controlling Hospital-Acquired Infection: Focus on the Role of the Environment and New Technologies for Decontamination," Clinical Microbiology Reviews, 2014, vol. 27, No. 4, pp. 665-690.
Pyrek, Kelly M., "Portable Medical Equipment: A Significant Source of Transmission," Infection Control Today, https://www.infectioncontroltoday.com/view/portable-medical-equipment-significant-source-transmission/, Accessed: Jul. 2, 2021, pp. 1-9.
Russotto, Vincenzo et al., "Bacterial contamination of inanimate surfaces and equipment in the intensive care unit," Journal of Intensive Care, 2015, vol. 3, Article 54, pp. 1-8.
Boyce, John M., "Modern technologies for improving cleaning and disinfection of environmental surfaces in hospitals," Antimicrobial Resistance and Infection Control, 2016, vol. 5, Article 10, pp. 1-10.
Messina, Gabriele et al., "Environmental Contaminants in Hospital Settings and Progress in Disinfecting Techniques," BioMed Research International, 2013, vol. 2013, pp. 1-8.
Bonetta, Silvia et al., "Photocatalytic bacterial inactivation by TIO2-coated surfaces," AMB Express, 2013, vol. 3, Article 59, pp. 1-8.
Tamstech, "Air Permeable (Breathable) Film," http://tamstech.net/airfilm/, Accessed: Jul. 2, 2021, pp. 1-6.
Siracusa, Valentina, "Food Packaging Permeability Behaviour: A Report," International Journal of Polymer Science, 2012, vol. 2012, pp. 1-11.
Lee, Young-Ho et al., "The photodynamic therapy on *Streptococcus* mutans biofilms using erythrosine and dental halogen curing unit," International Journal of Oral Science, 2012, vol. 4, pp. 196-201.
MacoPharma, "THERAFLEX-MB Plasma," https://www.mhlw.go.jp/shingi/2008/05/dl/s0523-7j.pdf, Accessed: Dec. 1, 2021, pp. 1-33.
Spagnul, Cinzia et al., "Immobilized Photosensitisers for antimicrobial applications," Journal of Photochemistry and Photobiology, 2015, vol. 150, pp. 11-30.
Wakayama, Nobuko I. et al., "Magnetic Acceleration of Inhaled and Exhaled Flows in Breathing," Japanese Journal of Applied Physics, 2000, vol. 39, pp. L262-L264.
Matsui, Aya et al., "Real-Time Near-Infrared Fluorescence-Guided Identification of the Ureters using Methylene Blue," Surgery, 2010, vol. 148, No. 1, pp. 78-86.
Ogilby, Peter R., "Singlet oxygen: There is indeed something new under the sun," Chemical Society Reviews, 2010, vol. 39, No. 8, pp. 3181-3209.
Klasse, P.J., "Molecular determinants of the ratio of inert to infectious virus particles," Progress in Molecular Biology and Translational Science, 2015, vol. 129, pp. 285-326.
Prausnitz, Mark R. et al., "Microneedle-based vaccines," Vaccines for Pandemic Influenza, Current Topics in Microbiology and Immunology, 2009, vol. 333, pp. 369-393.
Fracalossi, Camila et al., "Singlet oxygen production by combining erythrosine and halogen light for photodynamic inactivation of *Streptococcus* mutans," Photodiagnosis and Photodynamic Therapy, 2016, vol. 15, pp. 127-132.
Noimark, Sacha et al., "Light-activated antimicrobial surfaces with enhanced efficacy induced by a dark-activated mechanism," Chemical Science, 2014, vol. 5, pp. 2216-2223.
Noimark, Sacha et al., "Incorporation of methylene blue and nanogold into polyvinyl chloride catheters; A new approach for light-activated disinfection of surfaces," Journal of Materials Chemistry, 2012, vol. 22, Iss. 30, pp. 15388-15396.
Waldman, Robert H. et al., "Immunization Against Influenza: Prevention of Illness in Man by Aerosolized Inactivated Vaccine," JAMA, 1969, vol. 207, No. 3, pp. 520-524.

(56) References Cited

OTHER PUBLICATIONS

Sharma, Rashmi et al., "Natrual Edible Oils: Comparative Health Aspects of Sesame, Coconut, Mustard (Rape Seed) and Groundnut (Peanut) A Biomedical Approach," Biomedical Journal of Scientific & Technical Research, 2017, vol. 1, Iss. 5, pp. 1375-1377.
LFA Tablet Presses, "Tablet Binders," https://www.lfatabletpresses.com/articles/tablet-binders, Accessed: Dec. 6, 2021, pp. 1-8.
International Search Report and Written Opinion for International Patent Application No. PCT/US2021/058678 mailed Jan. 25, 2022, pp. 1-9.
Gonzalez, Murielle, "Hartalega: Expansion plan on track," Cleanroom Technology, 2019, https://cleanroomtechnology.com/news/article_page/Hartalega_Expansion_plan_on_track/153507, Accessed: Apr. 6, 2022, pp. 1-4.
Office Communication for U.S. Appl. No. 17/522,811 mailed Apr. 14, 2022, pp. 1-7.
Midden, Robert W. et al., "Singlet Oxygen Generation for Solution Kinetics: Clean and Simple," Journal of the American Chemical Society, Jun. 1983, vol. 105, No. 13, pp. 4129-4135.
Plotino, G. et al., "Photodynamic therapy in endodontics," International Endodontic Journal, Jun. 2019, vol. 52, Issue 6, pp. 760-774.
Meller, David M. et al., "Photodisinfection Therapy: Essential Technology for Infection Control," The Infection Prevention Strategy, Jan. 2020, https://infectioncontrol.tips/2020/01/17/photodisinfection-therapy/, Accessed: Jun. 7, 2022, pp. 1-13.
"What is Photodisinfection?," Ondine Biomedical Inc., https://ondinebio.com/technology/, Accessed: Jun. 7, 2022, pp. 1-4.
Almeida, Adelaide et al., "Phage Therapy and Photodynamic Therapy: Low Environmental Impact Approaches to Inactivate Microorganisms in Fish Farming Plants," Marine Drugs, 2009, vol. 7, No. 3, pp. 268-313.
Hasenleitner, Martina et al., "In the Right Light: Photodynamic Inactivation of Microorganisms Using a LED-Based Illumination Device Tailored for the Antimicrobial Application," Antibiotics, Dec. 2019, vol. 9, pp. 1-13.
Trempolec, Natalia et al., "Photodynamic Therapy-Based Dendritic Cell Vaccination Suited to Treat Peritoneal Mesothelioma," Cancers, Feb. 2020, vol. 12, pp. 1-16.
International Search Report and Written Opinion for International Patent Application No. PCT/US2021/046419 mailed Feb. 2, 2022, pp. 1-11.
International Search Report and Written Opinion for International Patent Application No. PCT/US2021/048444 mailed Feb. 1, 2022, pp. 1-14.
International Search Report and Written Opinion for International Patent Application No. PCT/US2021/046416 malled Nov. 8, 2021, pp. 1-9.
International Search Report and Written Opinion for International Patent Application No. PCT/US2021/046417 mailed Nov. 30, 2021, pp. 1-11.
International Search Report and Written Opinion for International Patent Application No. PCT/US2021/046722 mailed Dec. 6, 2021, pp. 1-9.
Office Communication for U.S. Appl. No. 17/522,811 mailed Jul. 26, 2022, pp. 1-9.
Cagno, Valeria et al., "Methylene Blue has a potent antiviral activity against SARS-CoV-2 and H1N1 influenza virus in the absence of UV-activation in vitro," Scientific Reports, Jul. 2021, vol. 11, Article No. 14295, pp. 1-8.
Buettner, Garry R. et al., "Hydrogen Peroxide and Hydroxyl Radical Formation by Methylene Blue in the Presence of Ascorbic Acid," Radiation and Environmental Biophysics, 1984, vol. 23, pp. 235-243.
Liang, Ji-Yuan et al., "Blue light induced free radicals from riboflavin on *E. coli* DNA damage," Journal of Photochemistry and Photobiology B: Biology, Feb. 2013, vol. 119, pp. 60-64.
Huang, Gangliang et al., "Chitosan and its derivatives as vehicles for drug delivery," Drug Delivery, 2017, vol. 24, No. 2, pp. 108-113.
Adepu, Shivakalyani et al., "Controlled Drug Delivery Systems: Current Status and Future Directions," Molecules, Sep. 2021, vol. 26, No. 19, Article No. 5905, pp. 1-45.
Woolley, Joseph T. et al., "Light Penetration and Light-induced Seed Germination in Soil," Plant Physiology, Apr. 1978, vol. 61, No. 4, pp. 597-600.
Baranoski, Gladimir V.G. et al., "On the Light Penetration in Natural Sands," 2019 IEEE International Geoscience and Remote Sensing Symposium (IGARSS 2019), 2019, pp. 6933-6936.
Office Communication for U.S. Appl. No. 18/100,993 mailed Apr. 13, 2023, pp. 1-6.
Office Communication for U.S. Appl. No. 17/958,639 mailed April 25, 2023, pp. 1-10.
Castano, Fernando et al., "Obstacle Recognition Based on Machine Learning for On-Chip LiDAR Sensors in a Cyber-Physical System," Sensors, Sep. 2017, vol. 17, No. 9:2109, pp. 1-14.
De Ponte Muller, Fabian, "Survey on Ranging Sensors and Cooperative Techniques for Relative Positioning of Vehicles," Sensors, Jan. 2017, vol. 17, No. 2:271, pp. 1-27.
Navarro, Pedro J. et al., "A Machine Learning Approach to Pedestrian Detection for Autonomous Vehicles Using High-Definition 3D Range Data," Sensors, 2017, vol. 17, No. 1:18, pp. 1-20.
Moses, Allistair et al., "Radar-Based Detection and Identification for Miniature Air Vehicles," IEEE International Conference on Control Applications (CCA), Sep. 2011, pp. 933-940.
Wu, Fang et al., "A Compact Magnetic Field-Based Obstacle Detection and Avoidance System for Miniature Spherical Robots," Sensors, May 2017, vol. 17, No. 6:1231, pp. 1-20.
Li, Dao et al., "Brain Injury Differences in Frontal Impact Crash Using Different Simulation Strategies," Computational and Mathematical Methods in Medicine, 2015, vol. 2015, Article ID 348947, pp. 1-8.
Ng, Laurel J. et al., "A Mechanistic End-to-End Concussion Model That Translates Head Kinematics to Neurologic Injury," Frontiers in Neurology, Jun. 2017, vol. 8, Article 269, pp. 1-18.
Post, Andrew et al., "Pediatric concussion: biomechanical differences between outcomes of transient and persistent (> 4 weeks) postconcussion symptoms," Journal of Neurosurgery: Pediatrics, Jun. 2017, vol. 19, No. 6, pp. 641-651.
Martin, GT, "Acute brain trauma," Annals of the Royal College of Surgeons of England, Jan. 2016, vol. 98, No. 1, pp. 6-10.
Holliday, Charles O., Jr et al., "Concussion: A National Challenge," The Bridge, National Academy of Engineering, 2016, vol. 46, No. 1, pp. 1-132.
Wojnarowicz, Mark W. et al., "Considerations for Experimental Animal Models of Concussion, Traumatic Brain Injury, and Chronic Traumatic Encephalopathy—These Matters Matter," Frontiers in Neurology, Jun. 2017, vol. 8, Article 240, pp. 1-14.
Babbs, Charles F., "Brain motion and deformation during closed head injury in the presence of cerebrospinal fluid," Weldon School of Biomedical Engineering Faculty Publications, Jun. 2004, Paper 41, pp. 1-39.
Citerio, Giuseppe et al., "Induced abdominal compartment syndrome increases intracranial pressure in neurotrauma patients: A prospective study," Critical Care Medicine, Jul. 2001, vol. 29, No. 7, pp. 1466-1471.
Bayly, Philip V. et al., "Deformation of the human brain induced by mild acceleration," Journal of Neurotrauma, NIH Public Access, Author Manuscript, 2005, PMCID PMC2377024, pp. 1-18.
Huynh, Quoc T. et al., "Optimization of an Accelerometer and Gyroscope-Based Fall Detection Algorithm," Journal of Sensors, Apr. 2015, vol. 2015, Article ID 452078, pp. 1-8.
Feng, Y. et al., "Relative brain displacement and deformation during constrained mild frontal head impact," Journal of the Royal Society Interface, May 2010, vol. 7, pp. 1677-1688.
Hogan, Quinn H. et al., "Magnetic Resonance Imaging of Cerebrospinal Fluid Volume and the Influence of Body Habitus and Abdominal Pressure," Anesthesiology, Jun. 1996, vol. 84, No. 6, pp. 1341-1349.
Ji, Songbai et al., "In Vivo Measurements of Human Brain Displacement," Stapp Car Crash Journal, Nov. 2004, vol. 48, pp. 1-11.

(56) References Cited

OTHER PUBLICATIONS

Kim, Sungho, "High-Speed Incoming Infrared Target Detection by Fusion of Spatial and Temporal Detectors," Sensors, Mar. 2015, vol. 15, No. 4, pp. 7267-7293.
Koral, K. et al., "Alterations in cerebrospinal fluid flow dynamics and pressure gradient generated by acute and chronic changes in intraabdominal pressure: Early results of MRI measurements performed on volunteers at 3 Tesla," European Society of Radiology, EPOS, 2010, Poster No. C-2474, pp. 1-10.
Hiscox, Lucy V. et al., "Magnetic resonance elastography (MRE) of the human brain: technique, findings and clinical applications," Physics in Medicine & Biology, Nov. 2016, vol. 61, pp. R401-R437.
Myer, Gregory D. et al., "Analysis of head impact exposure and brain microstructure response in a season-long application of a jugular vein compression collar: a prospective, neuroimaging investigation in American football," British Journal of Sports Medicine, Oct. 2016, vol. 50, No. 20, pp. 1-11.
Slobounov, Semyon M. et al., "The effect of repetitive subconcussive collisions on brain integrity in collegiate football players over a single football season: A multi-modal neuroimaging study," NeuroImage: Clinical, 2017, vol. 14, pp. 708-718.
Yamada, Shinya, "Cerebrospinal fluid physiology: visualization of cerebrospinal fluid dynamics using the magnetic resonance imaging Time-Spatial Inversion Pulse method," Croatian Medical Journal, Aug. 2014, vol. 55, No. 4, pp. 337-346.
Zhu, Qiliang et al., "In Vivo Measurements of Human Brain Displacement," 2003 Summer Bioengineering Conference, Jun. 2003, pp. 1-2.
International Preliminary Report on Patentability for International Patent Application No. PCT/US2021/046722 mailed Mar. 2, 2023, pp. 1-7.
Gabay, Jon, "Sensor-Based Collision Avoidance Solutions for Drone Fleets," DigiKey, https://www.digikey.com/en/articles/sensor-based-collision avoidance-solutions-for-drone-fleets, Mar. 2016, Accessed: Jun. 6, 2023, pp. 1-6.
Office Communication for U.S. Appl. No. 18/100,993 mailed Jun. 15, 2023, pp. 1-11.
Office Communication for U.S. Appl. No. 17/958,639 mailed Aug. 8, 2023, pp. 1-9.
Office Communication for U.S. Appl. No. 18/205,082 mailed Aug. 16, 2023, pp. 1-13.
Office Communication for U.S. Appl. No. 18/379,863 mailed Dec. 27, 2024, 4 Pages.
Office Communication for U.S. Appl. No. 18/379,863 mailed Jan. 30, 2024, 13 Pages.
Office Communication for U.S. Appl. No. 18/205,082 mailed May 16, 2024, 15 Pages.
Office Communication for U.S. Appl. No. 18/379,863 mailed Oct. 9, 2024, 12 Pages.
Kim et al., "Photocatalytic detoxification of a sulfur mustard simulant under realistic conditions by imidazoline-based porous organic polymer composites", Cell Reports Physical Science, vol. 3, Issue 5, 100888, May 18, 2022, pp. 1-19.
Ayoub et al., "Air oxidation of sulfur mustard gas simulants using a pyrene-based metal—organic framework photocatalyst", Beilstein Journal of Nanotechnology, vol. 10, 2019, pp. 2422-2427.
Ayoub et al., "Air oxidation of sulfur mustard gas simulants using a pyrene-based metal—organic framework photocatalyst", Supporting Information, Beilstein Journal of Nanotechnology, vol. 10, 2019, pp. S1-S10.
Atilgan et al., "Detoxification of a Sulfur Mustard Simulant Using a BODIPY Functionalized Zirconium-Based Metal—Organic Framework", ACS Appl. Mater. Interfaces 2017, vol. 9, pp. 24555-24560.
Atilgan et al., "Detoxification of a Sulfur Mustard Simulant Using a BODIPY Functionalized Zirconium-Based Metal—Organic Framework", Supporting Information, ACS Appl. Mater. Interfaces 2017, vol. 9, pp. S1-S14.

* cited by examiner

SKIN PROTECTION AGAINST MICROBIAL PARTICLES

CROSS-REFERENCES TO RELATED APPLICATIONS

This application is a Utility Patent application based on previously filed U.S. Provisional Patent Application No. 63/397,321, filed on Aug. 11, 2022, and U.S. Provisional Patent Application No. 63/398,796, filed on Aug. 17, 2022, and U.S. Provisional Patent Application No. 63/441,139, filed on Jan. 25, 2023, and U.S. Provisional Patent Application No. 63/463,437, filed on May 2, 2023, and U.S. Provisional Patent Application No. 63/523,596, filed on Jun. 27, 2023, and U.S. Provisional Patent Application No. 63/525,312, filed on Jul. 6, 2023, the benefit of the filing dates of which is hereby claimed under 35 U.S.C. § 119(e) and the contents of these provisional applications is herein incorporated by reference in their entirety.

BACKGROUND INFORMATION

Chemical and biological agents (CWA), microbial pathogens, deliberately harmful or accidental radiation exposure, and other related threats to health can present with direct damage to skin surfaces, conjunctival surfaces, hair, and mucosa when transmitted through the air or by direct and indirect touch and surface contact, which may include exposure via damaged surface tissues and injections or any process that breaches the skin. In addition to direct and indirect biological surface skin, conjunctival, hair, and mucosal toxicity, these agents, substances, and pathogens may be absorbed through these same surfaces and induce systemic toxic effects, leading to major morbidity and mortality. Various threats may include, but are not exclusively organophosphates, nerve agents, sulphur and nitrogen mustards, chlorine compounds, opioids, ricin, all manner of pathogenic viruses, bacteria, parasites, fungi, prions, spores, ammonia compounds, poisonous gases, cyanide compounds, acids, bases, and other many types and classes of toxins, venoms, and poisons, and various forms of radiation. Some of these agents are intrinsically or by design colorless, odorless, dispersible in air or on surfaces, with no known antidotes or effective treatments or therapies. Clearly, there is a need for prevention of biological surface contact and other countermeasures for the plethora of CWA and other pathogens, and deleterious substances, natural or artificially created, and harmful radiation exposures, which is the subject of the present disclosure.

BRIEF DESCRIPTION OF FIGURES

FIG. 4A also depicts hook S reversibly inserted into tab or loop R, enabling doffing of protective fabric C.

FIGS. 11D and 11E depict fabric 13*c* incorporating photosensitizer 13*a* further processed with water repellent formulation 13*f* which is washed-in or applied to fabric 13*c*, creating a water repellent layer 13Fa on surface of fabric 13*ca* which is represented by the cross hatched layer. Also shown is fabric 13*c* incorporating optically transparent polymeric discs 13*g* in a grid pattern, admitting ambient light 13*h* represented by the circle, transmitted through clear polymeric disc 3*g* to proximate skin layer 13*i*, where photoactivation of photosensitizer formulation 13*j* can occur.

BRIEF DESCRIPTION OF VARIOUS EMBODIMENTS

Figure 1A:
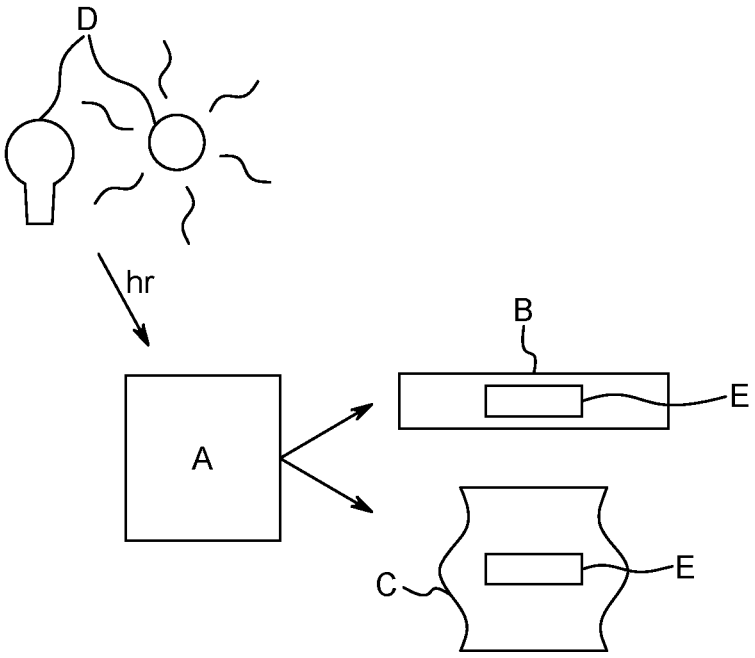
FIG. 1A depicts block A which represents at least one photosensitizer formulation applied to biological surface B or protective fabric C. Block A photosensitizer is optionally photoactivated by light source D, which decontaminates pathogen, toxin, poison E.
Figure 1B:
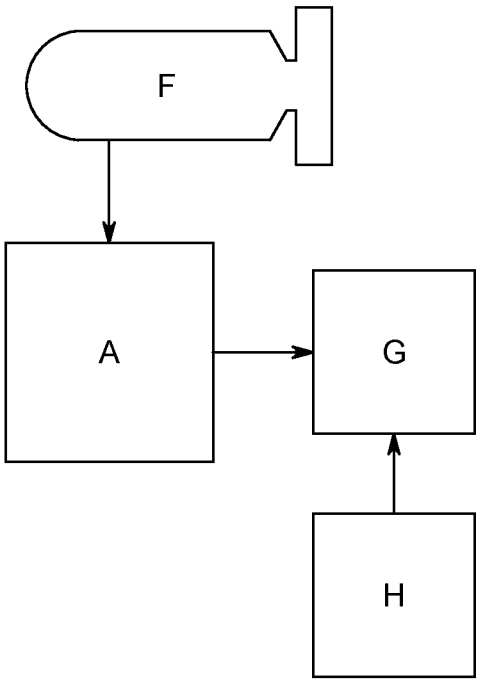
FIG. 1B also shows block A photosensitizer formulation impinged by radiation source F, generating reactive species G which is quenched or neutralized by substance H.
Figure 1C:
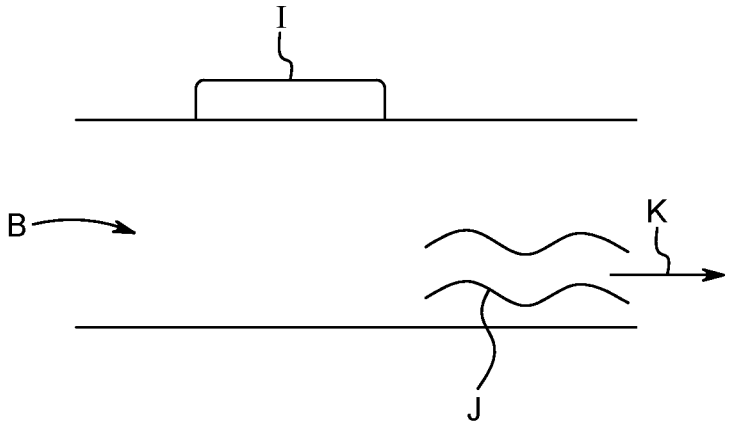
FIG. 1C also shows methylene blue photosensitizer I, penetrating biological surface B, which vasoconstricts blood vessel J, reducing blood flow K.
Figure 2A:
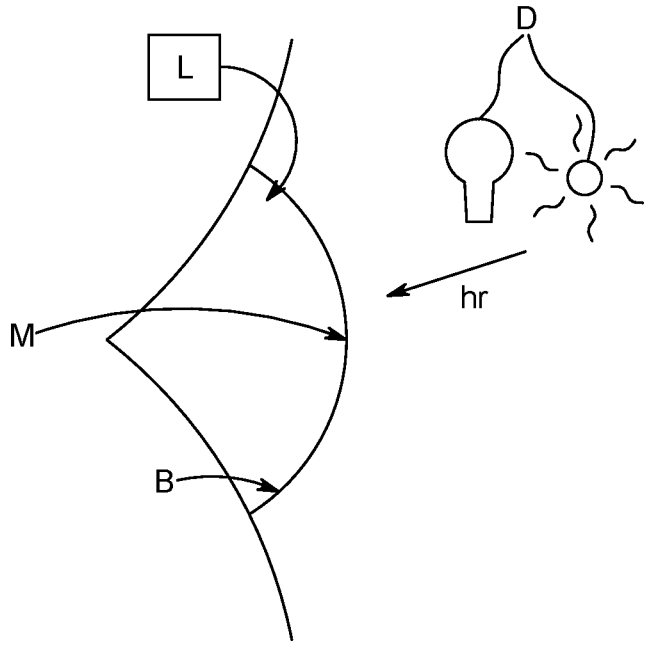
FIGS. 2A and 2B shows riboflavin photosensitizer L applied to eye conjunctival surface M, activated by light source D, causing superficial crosslinking of collagen M1 which aids in protection of the eye surface M.
Figure 2B:
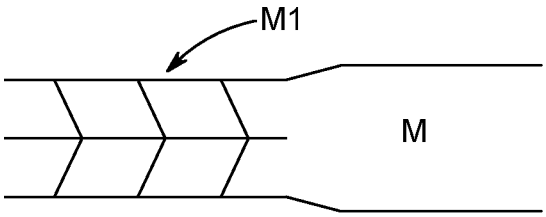
Figure 2C:
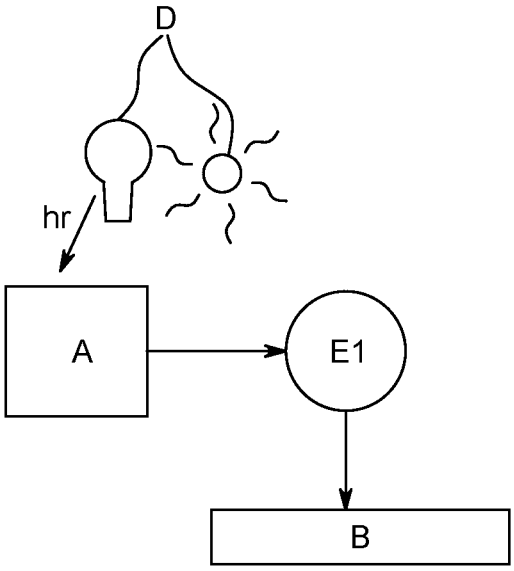
FIG. 2C also shows immunogen E1 generated by interaction of photosensitizer A and light source D, which is inhaled, ingested, or interacts with biological surface B.
Figure 3A:
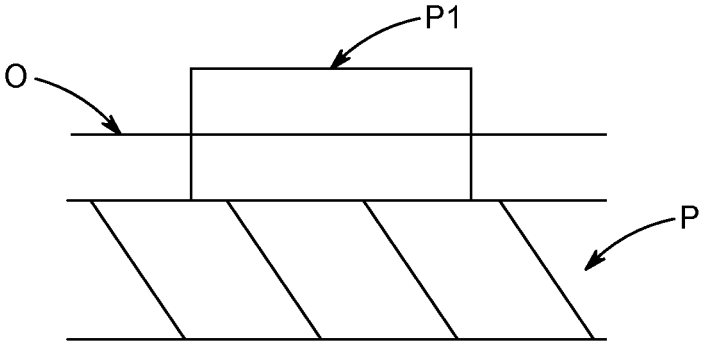
FIGS. 3A and 3B shows nitinol strut 0 on the surface of cross hatched pant leg P, wherein the nitinol strut 0 is positioned within sleeve P1 which is attached to pant leg P, holding pant leg P in an open position for ease of insertion of limb Q.
Figure 3B:
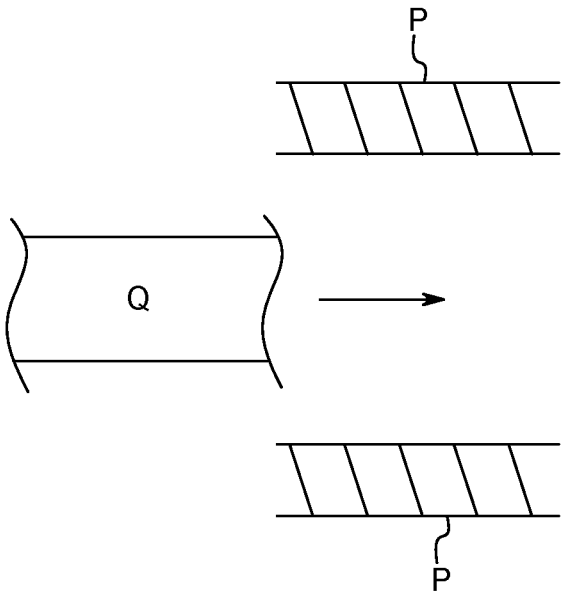
Figure 3C:
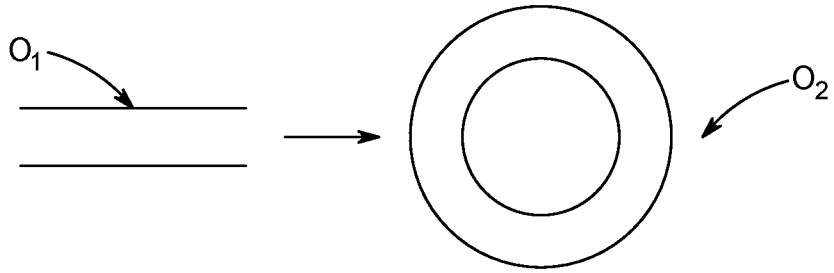
FIG. 3C shows nitinol strut 01 in a collapsed state, deploying to an opened rounded/oval state 02.
Figure 4A:
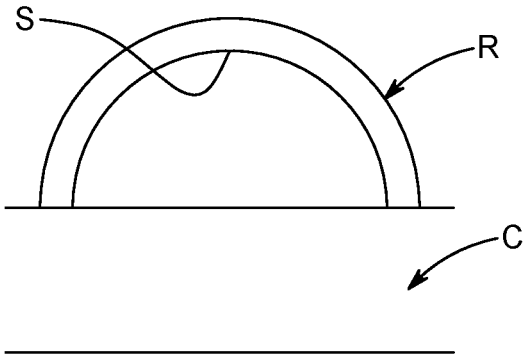
FIG. 4A shows tabs or loops R externally fastened using epoxy or sewn to protective fabric C.
Figure 4B:
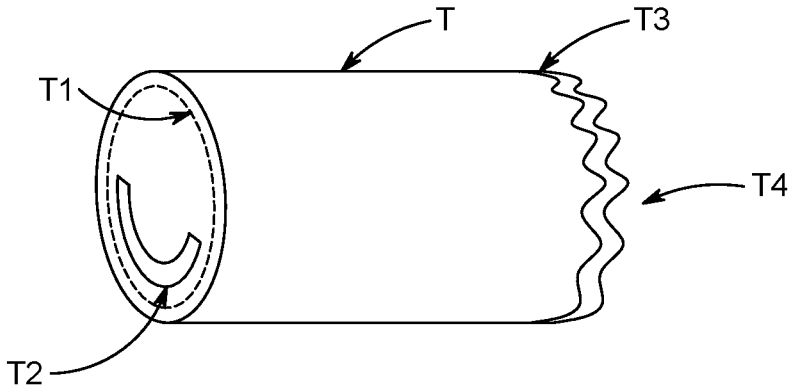
FIG. 4B depicts protective fabric sleeve T with adhesive layer T1, protective peel-away backing T2, at one end of fabric sleeve T, and polymeric elastic band or cable type of tie fastener T3 at the other end of fabric sleeve T4.
Figure 4C:
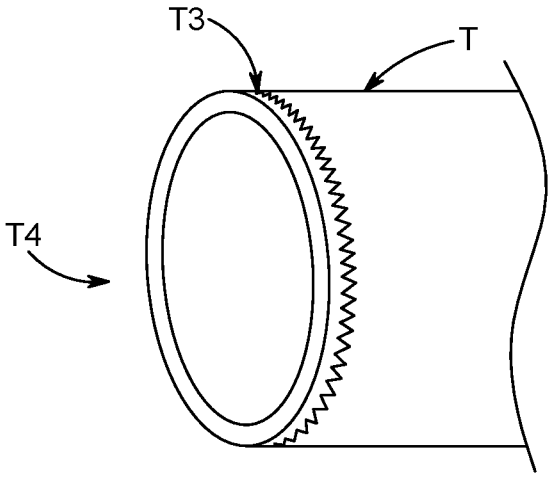
FIG. 4C shows enlarged view of protective fabric sleeve T shows a polymeric band or strut T5 holding the mouth of protective fabric sleeve T4 open such that it can encompass a wound or injury.
Figure 5A:
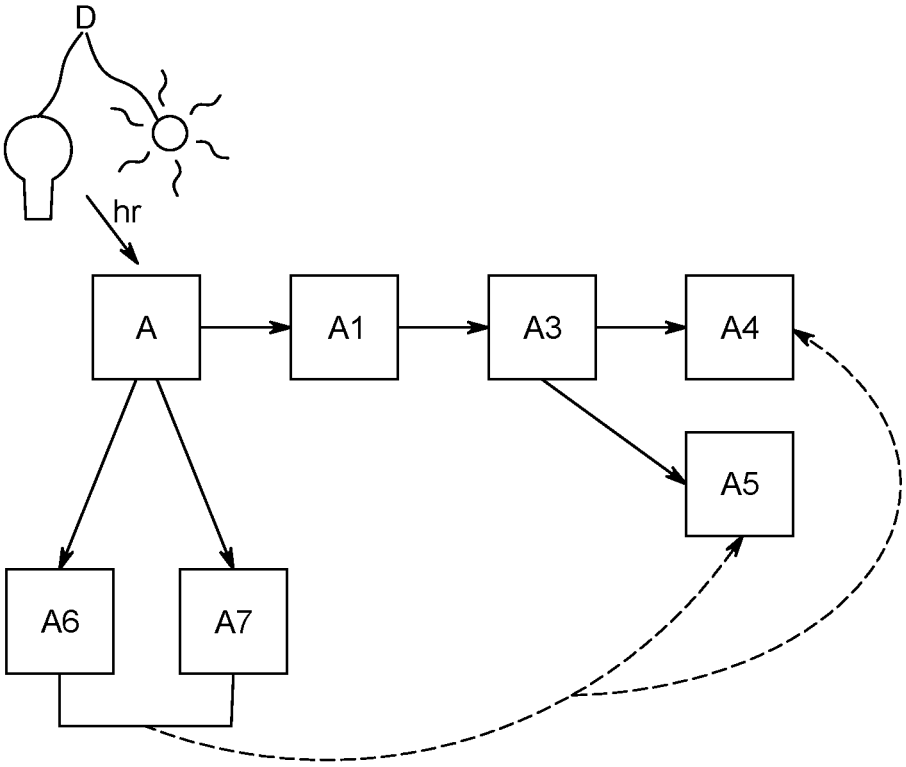
FIGS. 5A and 5B shows at least one photosensitizer block A reacting with ascorbate as a non-limiting example A1 creating oxidizing agent A3, which kills pathogen A4 and inactivates toxin A5. Photosensitizer block A also reacts with light emitted by light source D, leading to type I reaction A6 and type II reaction A7, both of which inactivates toxin A5 and kills pathogen A4. Also shown is photosensitizer block A reacting with radiation source A8, leading to formation of reactive species A9, which is neutralized by quenching reaction A10, which serves to mitigate harm to normal tissue A11.
Figure 5B:
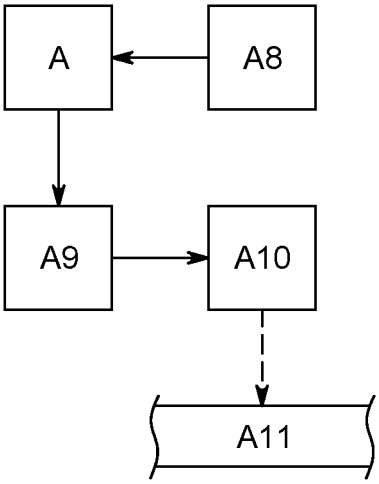
Figure 6:
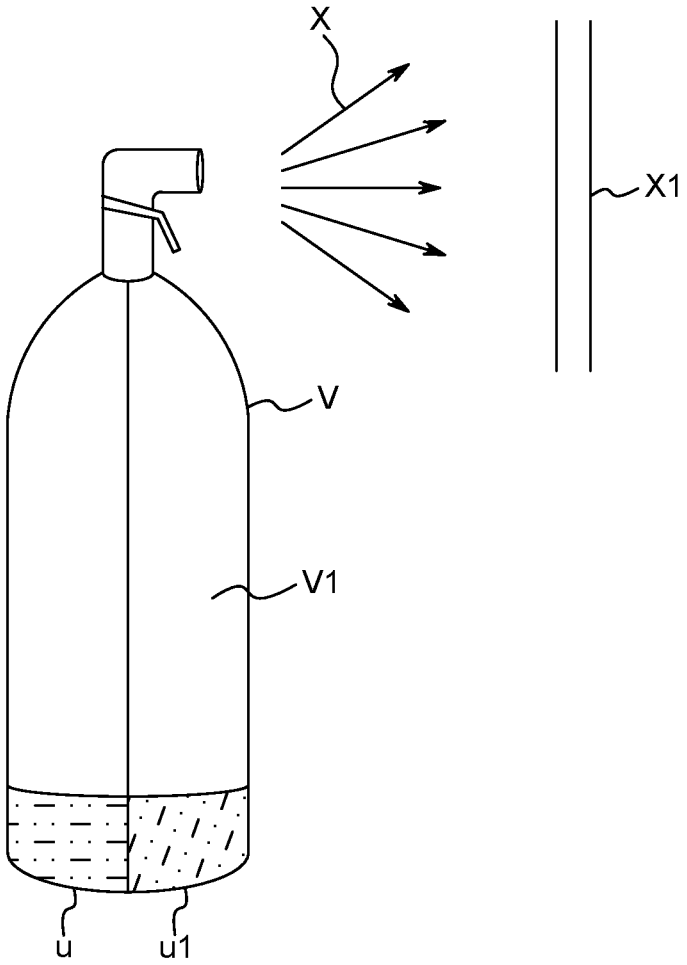
FIG. 6 depicts at least one photosensitizer in powder form U and other reactant which may be ascorbic acid U1, in two compartment spray bottle V. After water V1 is added, the spray X is applied to surface X1, which is optionally a textile, hard surface, or other soft surface, or deployed as an aerosol.
Figure 7A:
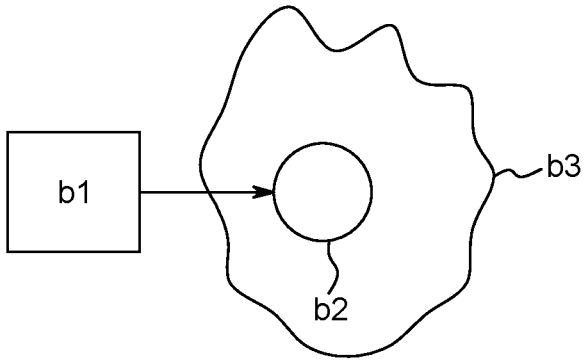
FIGS. 7A, 7B, 7C and 7D show a block diagram sprayer device, particulate generator device, or explosive device b1, emitting a photosensitizer substance b2 in an aerosol or droplet form into the ambient air b3. When photosensitizer b2 encounters pathogen, contaminant, or ionizing radiation source c1, a reaction occurs represented by shaded box c2, which comprises singlet oxygen and reactive oxygen species oval c3, which is then quenched by triangular species c4. This reaction protects proximate tissue layer d1. Also shown is pathogen, contaminant, or radiation source c1 drawn into fan device el where it is neutralized. Also shown is face cover f1 which disperses photosensitizer b2 into ambient air b3, where neutralization of pathogen, contaminant, or radiation source c1 occurs anterior to the face cover f1, protecting face g1.
Figure 7B:
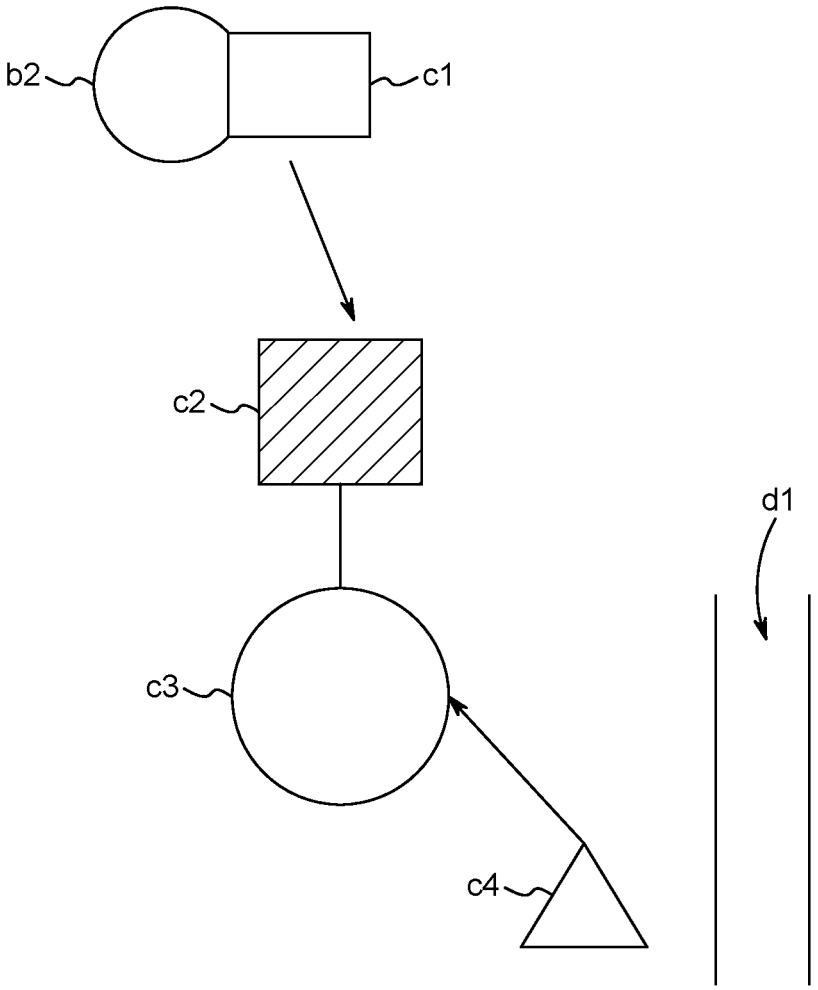
Figure 7C:
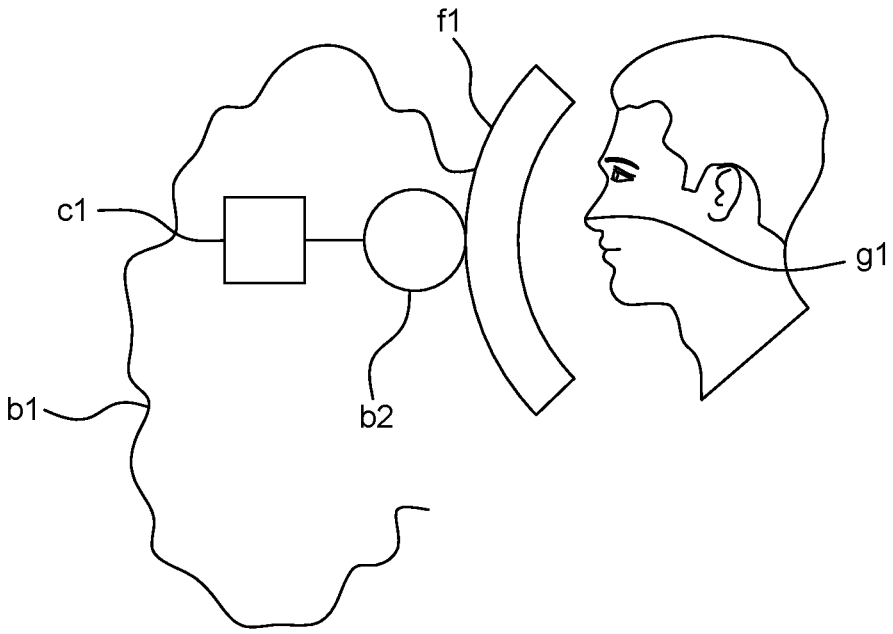
Figure 7D:
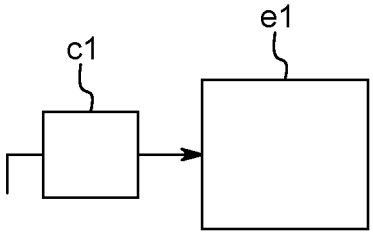
Figure 7E:
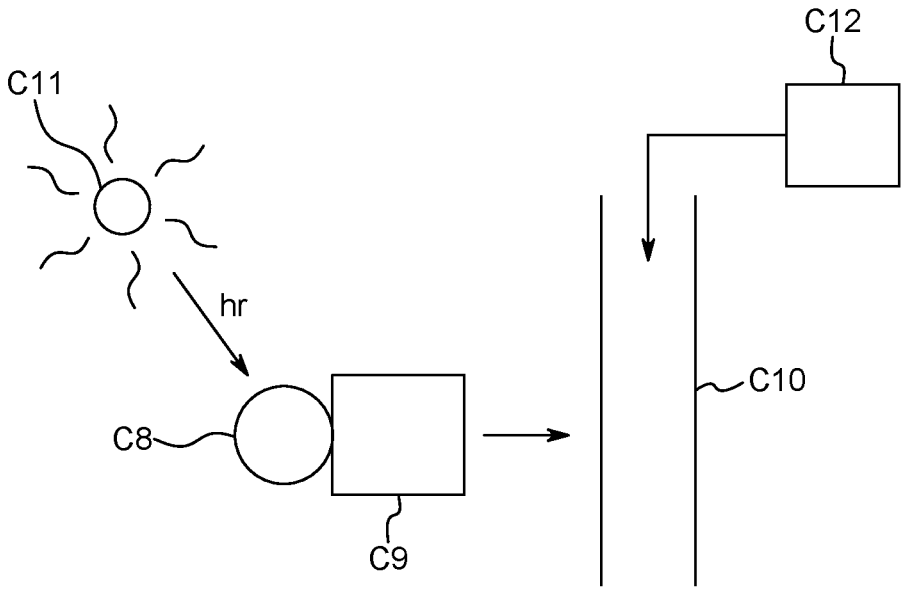
FIG. 7E depicts photosensitizer C8 in combination with activated charcoal/carbon powder or solution C9 applied to material or surface C10. Also shown is light source or other energy source C11 activating photosensitizer C8. Pathogen or toxin or VOC or malodorous substance C12 is trapped or absorbed by surface or material C10 incorporating photosensitizer C8 and activated charcoal/carbon powder or solution C9, where further inactivation or decontamination or neutralization takes place.
Figure 8:
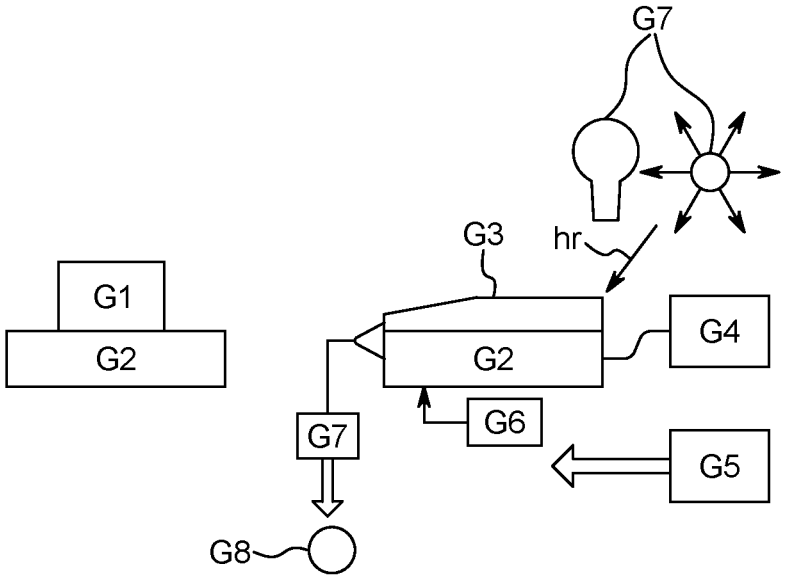
FIG. 8 shows in block form activated carbon, and/or silica gel, and/or active alumina G1 on a hard and/or soft surface or lumen G2. Also shown in block form is photosensitizer G3 disposed on hard and/or soft surface or lumen G2, which captures and binds toxin, or pathogen, or poison, or other dangerous and noxious substance G4. G1 can also represent activated carbon and a photosensitizer applied to a mucosal or epithelial surface also represented by G2. Block representation of air stream G5 is shown passing over the surface of the G3/G2 complex, causing poison, toxin, pathogen, noxious chemical G6 to be trapped and inactivated on complex G2/G3 activated by ambient or environmental light source G7 which can also be a manufactured light source such as a light emitting diode. Also depicted is photosensitizer G3 disposed on surface G2 which generates block G7 representing singlet oxygen and other reactive oxygen species generated by light source G7 which repels circle G8 representing insects such as mosquitoes, ticks, flies, and other noxious insects and bugs.
Figure 9A:
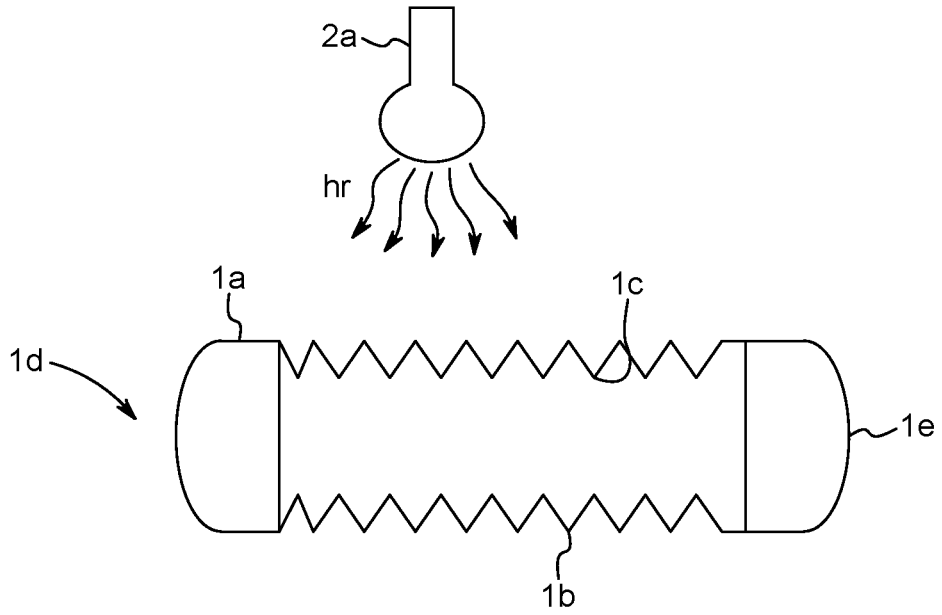
FIGS. 9A and 9B show tube 1*a* with corrugation 1*b* and incorporated photosensitizer 1*c* in luminal surface of tube 1*a*. Light source 2*a* illuminates the interior of lumen of tube 1*a*, photoactivating photosensitizer 1*c* which decontaminates air 1*d* passing through the lumen of tube 1*a*. Also shown is coiled polymeric tube represented by block 3*a*, with air inlet 3*b* which is cooler than warmer air outlet 3*c*, which is proximate to user face 4*a*. When user 4*a* inhales, decontaminated air 5*a* flows into mouth and nose of user 4*a*. Also shown is optionally incorporated air filter 1*e*. Also shown is reservoir 4*b* which contains at least one photosensitizer formulation 4*c* which optionally elutes into the lumen of tube 4*d*, when photoactivated by at least one light source/ambient light 2*a* decontaminates air 1*d* for inhalation by user 4*a*. Heating element 4*e* which is optionally comprised of known single use or reusable air activated exothermic reactive substances induces warmed disinfected, decontaminated air to rise proximate to user 4*a* for inhalation.
Figure 9B:
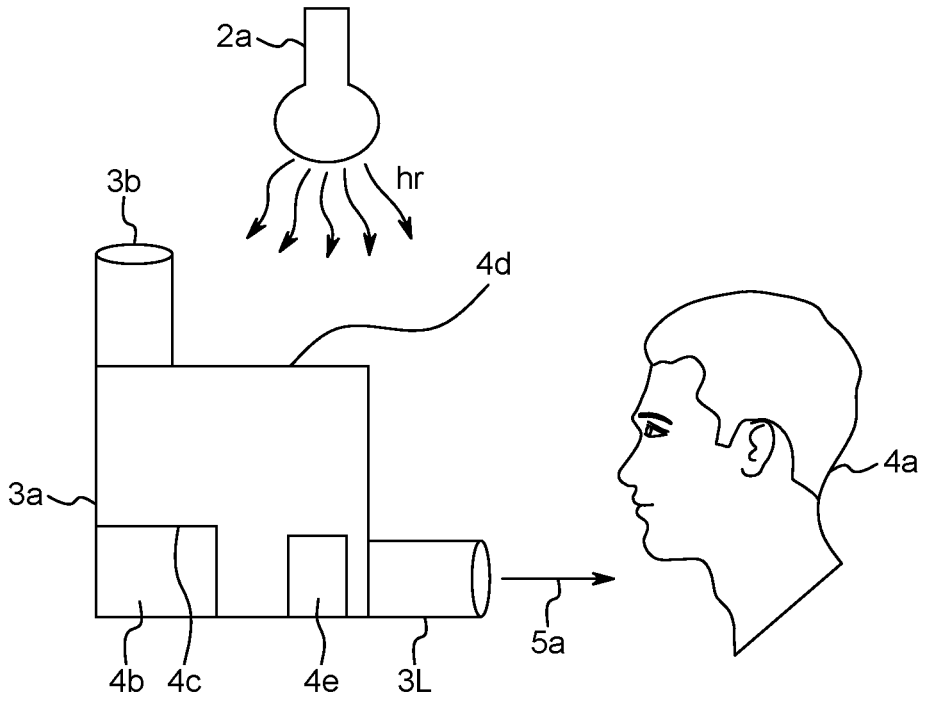
Figure 10A:
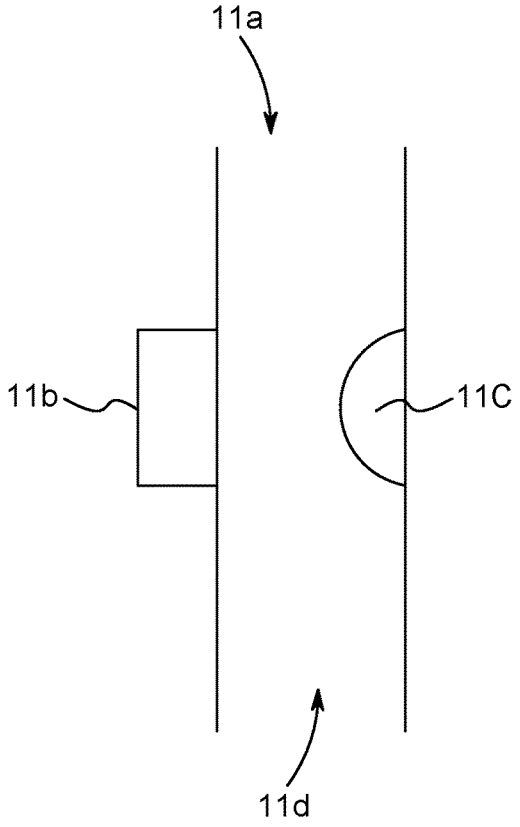
FIGS. 10A, 10B, 10C and 10D show transparent polymeric tube 11*a* illuminated by ambient light or discrete light source 11*b*, which photoactivates at least one photosensitizer 11*c* incorporated into polymeric tube 11*a*, which decontaminates flowing air 11*d* within tube 11*a*. Also shown is transparent tube 11*a* proximate to fabric 11*e* which incorporates photosensitizer 11*f* represented by the cross-hatch lines. Air 1*d* is drawn into the lumen of tube 11*a*, after passing through fabric 11*e*, where the air is decontaminated by photosensitizer 11*f* photoactivated by ambient light or discrete light source 11*b*. Also shown is tube 11*a* under shirt fabric 12*a* which incorporates a photosensitizer, with tube 1*a* directed towards face 12*b*, where inhalation of decontaminated air 11*d* occurs. Also shown is tube 1*a* incorporating heating element 12*c*, which induces warmed air 11*d* to flow in an upwards direction for inhalation by nose/mouth of face 12*b*.
Figure 10B:
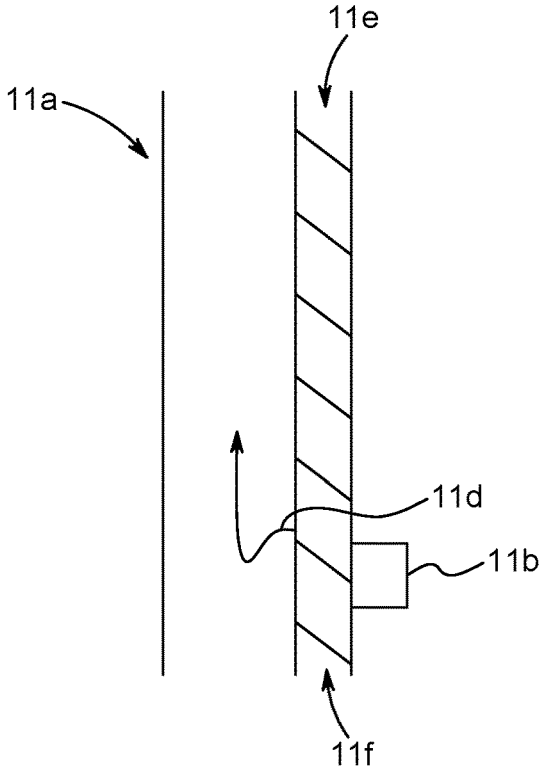
Figure 10C:
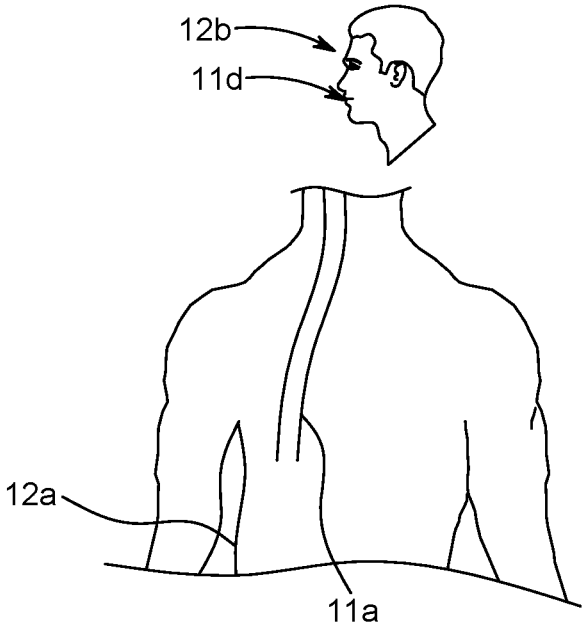
Figure 10D:
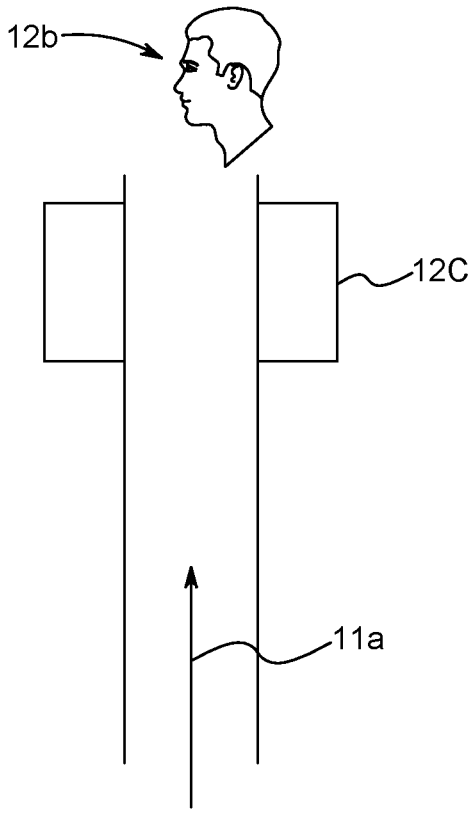
Figure 11A:
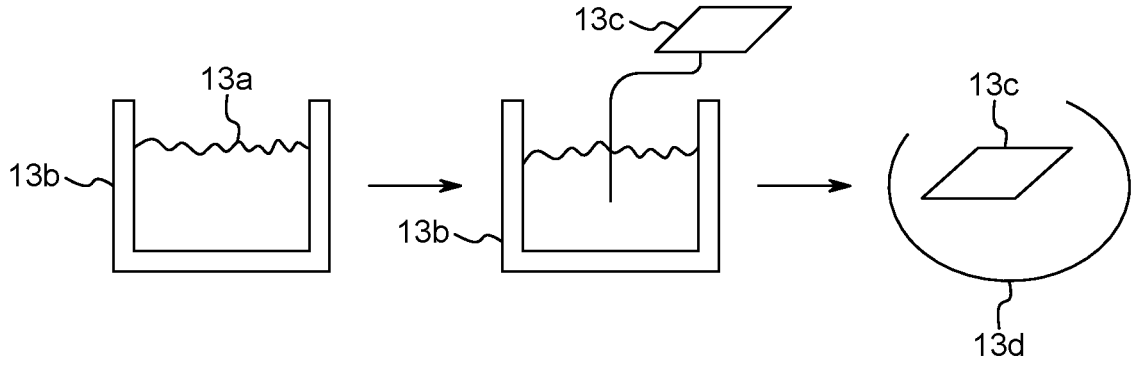
FIGS. 11A, 11B, 11C and 11D shows photosensitizer solution 13*a* in vat or container 13*b*, with fabric sample 13*c* dip coated or sublimated in container 13*b* at a temperature ranging from ambient room temperature to 250 degrees C., followed by fabric 13*c* drying in an oven represented by circle 13*d* at 50 degrees C. Also shown is washing machine or container 13*e* with added water repellent silicone formulation represented by circle 13*f*, incorporating photosensitizer solution 13*a*. In all cases, fabric 13*c* is inside the washing machine or container, and dyed with photosensitizer 13*a* and coated with the water repellent silicone 13*f*.
Figure 11B:
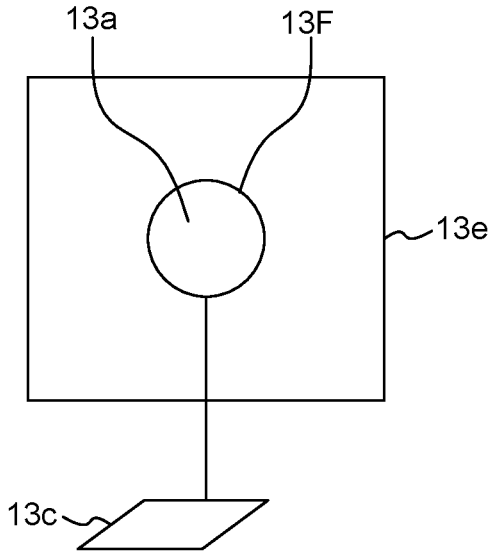
Figure 11C:
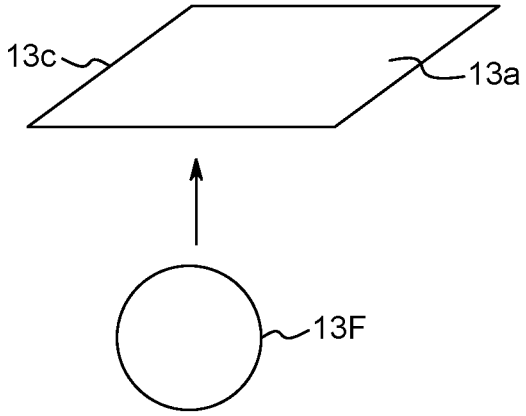
Figure 11D:
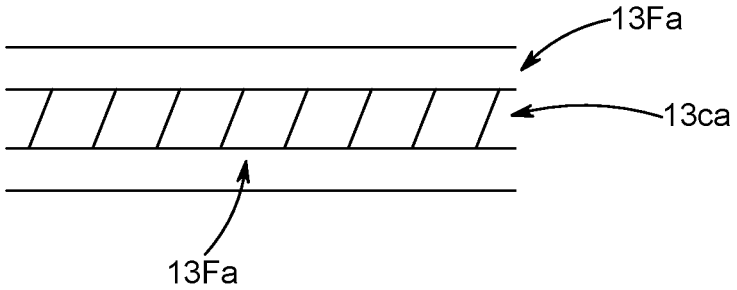
Figure 11E:
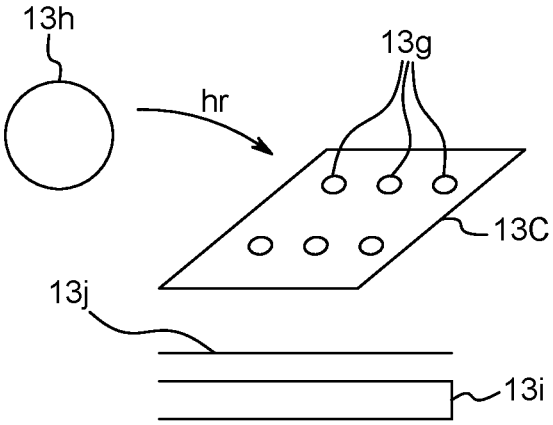

The present disclosure describes methods and physical substances, which are based on known and contemplated photoactive substances herein referred to as photosensitizers. It should be noted that said photosensitizers are also potentially active in dark or very low light levels, below light levels usually associated with known photodynamic actions. Photosensitizers included in the present disclosure include known and contemplated photosensitizers including but not limited to all types of methylene blue derivatives and methylene blue itself, chlorophyll derivatives, tetrapyrrole structures, porphyrins, chlorins, bacteriochlorins, phthalocyanines, texaphyrins, prodrugs such as aminolevulinic acids, phenothiaziniums, squaraine, boron compounds, various transition metal complexes, hypericin, riboflavin, curcumin, titanium dioxide, psoralens, tetracyclines, indocyanine green, flavins such as riboflavin, erythrosine, and the like. The invention also includes known or contemplated nanocompositions of photosensitizers and photosensitizers linked to a variety of other substances, or utilized in combination with other substances which may improve the photodynamic decontaminating effect. Light sources enabling photoactivation include can include, but are not limited to lasers, laser diodes, light emitting diodes, and other semiconductor light sources such as those using quantum dot technology. Fluorescent, incandescent lighting, ambient outdoor light, light from combustion of materials causing flame, are also included in the present disclosure. In general, at least one photosensitizer including methylene blue (MB), riboflavin (RF) its derivatives and the like, and optionally a skin penetrant enhancer such as low molecular weight hyaluronic acid are part of the present invention disclosure. Other skin penetrants may optionally include a variety of oils, dextrins, dimethylsulphoxide, cholates, surfactants, saponins, bile salts, ethers, liposomal formulations, azones, urea, pyrrolidones, alcohols, polysorbates, and other solvents known and used commercially as skin penetrants.

Photosensitizer concentration range: 0.001 micromolar to 1.0 molar, with preferred ranges of 10 micromolar to 1000 micromolar.

Hyaluronic acid concentration range: 0.001 micromolar to 1000 micromolar, though ranges above or below are part of the present disclosure.

Hyaluronic acid molecular weight: For skin penetration, low molecular weight 20-300 kDa are preferred, and to impede or prevent skin penetration, high molecular weight 1000-1400 kDa are preferred, though ranges above and below these putative parameters are part of the present disclosure.

In one embodiment MB and/or RF are topically applied to the biological surface which includes skin, conjunctiva, hair, and mucosa which when photoactivated produce singlet oxygen and other reactive oxygen species (ROS). Singlet oxygen and other ROS are known to inactivate and degrade CW agents, toxins, and various pathogens. Other beneficial inactivation reactions may occur when light exposure is limited or nonexistent, when photosensitizers are used at high concentrations, or in combination with reducing or oxidizing agents. Non-limiting examples include inactivation of SARS CoV-2 virus which causes COVID-19 by methylene blue at a concentration of 10 micrograms/ml, and a redox reaction of methylene blue and ascorbate producing antimicrobial hydrogen peroxide. In another embodiment, MB which may induce a blue surface stain due to its activity as a biological and textile dye, when applied to a biological surface is decolorized to leucomethylene blue using a reducing agent, such as ascorbate or vitamin C, if decolorization is desired. In yet another embodiment, methylene blue and/or riboflavin or other photosensitizers are applied as needed in an aqueous solution to hair, using a comb for example, in order to decontaminate CWA or other pathogens, toxins, and poisons contacting hair and the hair bearing surfaces.

In another embodiment, at least one photosensitizer is incorporated into a liquid formulation known in the commercialized "liquid bandage" field, whereby the liquid formulation is contained in an air tight, opaque spray or roll—on applicator type bottle, where upon application to a cutaneous wound exposed to air polymerizes into a hardened but flexible coating protecting the disinfecting the wound surface. Liquid bandage formulations may be comprised of various known biocompatible polymers dissolved in a biocompatible water or alcohol-based solvent. Upon contact with air, a protective thin film is rapidly formed which protects the cutaneous wound/injury when the excipient/carrier evaporates. Polymers used may non-exclusively include various substances and compounds such as polyvinylpyrrolidone, ethyl cellulose, pyroxylin/nitrocellulose or poly methylacrylate-isobutene-monoisopropylmaleate and acrylate or siloxane polymers.

In some embodiments, at least one photosensitizer such as methylene blue which was originally developed as a textile dye is sprayed, dipped, sublimated, spin coated, printed, or otherwise incorporated into fabrics and textiles using commonly known dyeing and dye application methods. Another embodiment adds at least one photosensitizer as needed or on demand as a spray formulation which may also optionally be applied during a laundering or drying process, to the fabric or textile to be treated, in order to replenish the photosensitizer which could be photobleached, or reduced in quantity by abrasion of the protective fabric. Methylene blue as a non-limiting example can be incorporated as a powder in the amount from 0.1 to 20 grams or more as a dissolvable in aqueous solution laundry pod, added to a washing cycle when laundering the protective fabric. Methylene blue and/or other photosensitizers could also be incorporated into a dryer sheet such as those used to add scent to drying clothes, by spraying the sheet with methylene blue and/or other photosensitizers and added during the protective fabric drying cycle.

In another embodiment, at least one photosensitizer such as methylene blue, riboflavin, rose bengal, and/or indocyanine green, as non-limiting photosensitizer examples can be added to a wetting agent or solvent such as methanol or super critical carbon dioxide as known substances that can be utilized to adhere at least one photosensitizer in concentrations ranging from 0.1% to 2.0% to a hydrophobic surface, such as may be found on water repellant coated fabrics or textiles, or that may be innately water repellant, such as a hydrophobic polymer such as polypropylene.

In yet another embodiment, the color of the photosensitizer(s) embedded or deposited on or within a fabric or textile or film is adjusted by combining photosensitizers of various types, such as methylene blue and riboflavin to create a greenish color, or methylene blue, riboflavin, and rose bengal to create a greenish brown range of color, as non-limiting examples.

In another embodiment, known phase change substances such as but limited to polyethylene glycol which are microencapsulated for containment purposes, are incorporated into the protective fabric, as is known in commercially available textiles in order to heat or cool the fabric as needed. In another embodiment the protective fabric incorporating the cooling or heating phase change substances are located proximate to the so called "pulse points", where major blood vessels including arteries are close to the skin surface. Pulse points can non-exclusively include the wrists, elbows, knees, feet, neck, groin, axilla, and the like.

Phase change materials are also comprised of various salts or organic compounds that can absorb heat till a melting point or phase change temperature is reached, at which point more heat is absorbed without the phase change materials changing in temperature.

In some embodiments, known phase change materials are incorporated into a face shield which is part of the protective suit. In some embodiments phase change materials may non-exclusively include waxes such as eicosane, octadecane, nonadecane, heptadecane, and hexadecane, which are known to be microencapsulated for incorporation into textiles and fabrics. Other phase change substances include paraffin wax, carboxylic acids, Glauber's salt which is sodium sulfate decahydrate, and calcium chloride hexahydrate. Such fabrics include knits, woven, or nonwoven materials, which can incorporate phase change substances in microcapsules, which may be comprised of polymers during manufacture of the fabric. Known fabric and textile manufacturing techniques that incorporate phase change materials include wet-spinning, matrix coating using coating substances such as polyurethanes, acrylics, and the like, various knifing techniques, padding techniques, dip and transfer coating, gravure processing, and foam dispersion using polyurethanes, as examples of application and incorporation methods and techniques known in the textile and fabric manufacturing industry.

In another embodiment, methylene blue and low molecular weight hyaluronic acid or other known skin penetrants are combined and applied topically to skin, to reduce skin blood flow. The known effect of methylene blue as a vasoconstrictor is used in this case to reduce skin blood flow which in turn reduces systemic exposure of CWA, toxins, poisons, dangerous gases and the like by restricting access of any skin penetrating deleterious, dangerous substances and agents to the blood stream. In another embodiment riboflavin and/or other photosensitizers are applied topically to skin, with or without a skin penetrant such as, but not limited to hyaluronic acid, and with light exposure, can induce cross-linking of collagen in the skin, which provides an added barrier function, augmenting the natural squamous cell barrier layer, in addition to generation of toxin inactivating and antimicrobial singlet oxygen and other reactive oxygen species. In yet another embodiment topical riboflavin and/or methylene blue or other photosensitizer application without a skin penetration enhancer leaves a thin film superficial to the skin surface which inactivates and kills microbes or detoxifies poisons contaminating the skin surface. In another embodiment a cross-linkable biocompatible substance such as hyaluronic acid and/or collagen is incorporated into the photosensitizer containing thin film, which when exposed to light produces a protective crosslinked layer or coating superficial to the skin. In yet another embodiment riboflavin is applied to the conjunctival surfaces of the eyes, and exposed to light which superficially crosslinks collagen in the cornea, helping to provide a barrier to toxins and poisons on the eye surface layers. For example, riboflavin briefly exposed to ultraviolet light is known to crosslink collagen, and is used clinically for this purpose to treat an abnormal eye condition known as keratoconus. Ultraviolet light can be delivered from a light emitting diode light source or ambient sunlight. In addition, a blue light source which activates riboflavin to induce crosslinking can be used if desired.

In one or more embodiments, where riboflavin is utilized, and a blue light source is used as a photoactivating energy source, the energy can range from 1 millijoule to 100 joules per cm, though ranges outside of these parameters are included in the present disclosure. In embodiments where riboflavin is used on biological surfaces, including skin and eyes, the formulation may optionally include aqueous 20% dextran with 0.146% riboflavin, which is approved by the US Food and Drug Administration for use in the eye to treat keratoconus. Ranges above and below the approved parameters are included in the present disclosure.

In another embodiment, in air generation of protective immunogens and immunologically beneficial antigens from the skin surface that are inhaled and/or swallowed, or contact the eyes with potential transfer via the nasolacrimal ducts to the nasal cavity can be protective by generating an innate and acquired immune response at the biological surface, which also includes the mucosal surfaces of the body.

In another embodiment, concentrations of at least one photosensitizer above 500 micromolar incorporated and embedded into, or sprayed, dipped, swabbed, or brushed onto the protective suit fabric to enable both known type I and type II photodynamic reactions to occur simultaneously, with the type II reactions generating singlet oxygen, and the type I reactions leading to electron transfer reactions generating various reactive oxygen species and other reactants by way of known chemistries. In yet another embodiment, other chemicals such as ascorbate, urea, DNA, RNA, and a variety of known reactants participate in the generation of other reduction/oxidation reactions in concert with at least one photosensitizer, generating hydrogen peroxide and other reactants, all of which are known to inactivate toxins, poisons, viruses, and kill a variety of pathogens.

In another embodiment, at least one photosensitizer such as methylene blue is formulated in an aqueous solution with ascorbates such that when illuminated, singlet oxygen is generated, via type 11 reactions, and when light levels are low, or when dark conditions prevail, hydrogen peroxide or other reactive species are generated via different reaction pathways, such as type 1, known in the photodynamic field. Of course, other beneficial and tissue and fabric/material protective chemical reactions by photosensitizers interacting with poisons, toxins, harmful gases, pathogens and the like are not precluded.

In one embodiment, at least one photosensitizer such as methylene blue when exposed to ionizing radiation generates reactive species which are quenched by adjacent photosensitizing molecules, protecting normal tissues from radiation injury.

In another embodiment, rapid donning of a protective suit is enabled by use of thin shape memory nitinol struts with similar flexibility to medical guidewires, which are reversibly inserted through fabric tunnels on the surface of the protective suit, keeping open, any portion of the protective suit such as the sleeves, thorax and abdominal part of the body suit, leggings, gloves, socks, neck area, and hood for rapid donning in case of emergent and imminent pathogen, toxin, poison, and dangerous gas exposure. The struts are thin, with diameters ranging from 0.01 inch to 0.10 inch. In one embodiment the nitinol struts are in a collapsed configuration, or folded flat but deployed in the rounded shape, into the fabric, enabling the protective suits to be folded in a flat shape or form. When the need arises to rapidly don the protective suit in an emergency, the struts can deploy virtually instantly into a rounded or ovoid shape, which enables rapid donning of the protective suit due to reduced friction, less impediment due to folded fabric during the donning process. Shape memory polymers or conventional polymers such as, but not exclusively nylon, in the form of bands such as those used as cable tie fasteners used for bundling, can also be used in the same fashion as an alternative to the nitinol struts. The polymeric bands may optionally incorporate a trigger release mechanism, as can be found on commercially available ties, allowing for tightening and loosening, such as may be required for emergency use as a tourniquet in the event of distal limb bleeding. The polymeric struts may be nonexclusively comprised of flexible nylon, hold an open loop configuration due to the thickness of the material as is the case for commercially available cable tie fasteners, and range in width from 1.0 mm to 1.0 cm, and with a thickness ranging from 1.0 to 5.0 mm, though ranges below or above these parameters are included in this disclosure.

In another embodiment, tabs or loops on suit that enable no-touch removal in case of significant contamination/radiation exposure, by enabling removal using a rod or hook, thus obviating the need for direct close contact and direct manual handling during doffing. In some embodiments the tabs or loops are of such a length that a gap of 1-2 inches in height are created by sewing or using an epoxy to fasten the tabs or loops to the protective fabric suit. In some embodiments the tabs or loops are located externally at the vertex of the head/hood segment of the protective suit, at the shoulders and/or wrists and/or volar hand surface and/or the dorsum of the feet segments, as non-limiting examples.

In another embodiment, the protective fabric is breathable, comprised of woven natural or synthetic fibers, in a manner creating loops of fibers outwardly and/or inwardly facing, which increases the protective surface area of the fabric, and the ability to capture or trap pathogens, toxins, and poisons. The loops can range in height 0.1 millimeter to 1.0 millimeter and occur at intervals of 0.001 millimeters to 1.0 millimeters.

In one embodiment, an optically clear polymeric, impact resistant face shield is hermetically sealed to the protective fabric suit, using known hermetic techniques such as compression sealing and/or epoxy sealing methods, to prevent exposure of the wearer/user of the protective suit to pathogens, toxins, and/or poisons by inadvertent leakage through a seam. In another embodiment, a sacrificial removable thin film, optically clear and incorporating countermeasures such as dilute formulations of at least one photosensitizer, is used to protect the face shield and the sacrificial thin film, which is positioned on the outward facing side of the face shield. Techniques and methods for embedding at least one photosensitizer into a polymer is known in the art, and an aqueous spray on formulation is included as part of the present disclosure.

In another embodiment, the head, neck, face, hands, and all other body surfaces can be protected by incorporating non-imaging lenses which admit ambient light to the inner fabric surface proximate to the skin of the user, where at least one photosensitizer coated or embedded into the fabric is localized. This feature permits effective protective photoactivation to occur on the undersurface of the fabric which otherwise may attenuate ambient external light falling upon the fabric surface when the fabric is worn by the user.

In another embodiment, a clean sticky but removable photoactive polymeric film such as polyethylene or polyurethane incorporating methylene blue and or other photosensitizers can be placed over high touch suit areas prior to doffing as well, to reduce potential touch contamination during doffing. Many types of adhesives are known in the medical adhesive art, and a non-stick removable backing such as are used on bandages prevents unwanted adhesion till use.

In one embodiment, a protective fabric incorporating at least one photosensitizer is fashioned into tubular shapes including for example (non-exclusively) sleeves, gaiters, chaps, aprons, gowns, caps, hats, shoe covers, gloves, and the like which can be used to cover wounds and infected skin surfaces, insulating the environment, and other proximate living organisms from the infective pathogens, such as various bacteria, fungi, viruses known to spread from superficial lesions. For example, monkeypox skin lesions which may present as rashes, pustules, and blisters are known to be infectious to others when contact occurs, whereas the protective fabric manufactured in a tubular or related shape, or cut to size and applied as a cover over the lesions can serve as a protective actively disinfecting barrier. Known biocompatible adhesives around the edges of the fabric, or tapes can be used to secure the protective fabric to the skin/body surface.

In another embodiment, a protective fabric can be retreated with at least one photosensitizer by spraying an aqueous solution onto the fabric surface, or by soaking the fabric in a water tight container or bag filled with at least one photosensitizer solution, or by laundering the protective fabric in a washing machine containing a dissolving laundry pod containing at least one photosensitizer formulation, or photosensitizer in a powder or granule form.

In another embodiment, straps surrounding the protective fabric suit limbs, pelvic area, torso, which when tightened down by pulling against an incorporated friction lock can serve to isolate that segment from the rest of the protective suit in the event that the fabric comprising the suit is torn or otherwise breached. This embodiment may also serve as an emergency tourniquet in the event of significant uncontrolled bleeding or oozing from a distal injury, such as may occur to a limb. In one embodiment, the straps are manufactured from a polymer with a known lubricious surface, which may be comprised of Teflon, silicone, polytetrafluoroethylene, or related substances, which reduces friction as straps are tightened or loosened. The removable straps are held in place by sewn or flexible epoxy formulations used to attach fabric tunnels, located on the external surface of the protective suit, through which the polymeric straps readily slide, in a loosening or tightening manner.

In another embodiment, methylene blue and/or riboflavin are provided in a small opaque polymeric spray bottle with a collagen formulation, for use as a spray on sealant, to seal tears, gashes, rips, worn areas or leaks in the protective suit fabric. The spray crosslinks in light to provide an adherent physical barrier and chemical countermeasure in the event of breaching of the protective fabric. In this embodiment the spray may also serve to provide hemostasis in the event of a bleeding injury, as hemostasis is known in photodynamic therapy to induce vascular stasis.

In yet another embodiment, urine and fecal passage, containment, and removal is allowed by incorporating a pouch or pocket which contains an absorbent material liner, comprised of known materials such as those used in baby diapers, which is reversibly attached on the inner groin region of the protective suit, anteriorly for urine capture and containment, and posteriorly for stool capture and containment, by an adhesive or Velcro type of attachment. The pocket or pouch is comprised of an impermeable polymer such as is found comprising the outer surfaces of baby diapers, and also incorporates an adhesive strip on the superior surface of the pouch which can be pressed closed after evacuation of urine or stool.

In yet another embodiment, the antimicrobial action of light and at least one photosensitizer on biological surfaces creates antimicrobial breakdown products which may be immunogenic, mimicking the natural, stereotypic immune response to infections. In this embodiment, a type of immunization and/or variolation effect occurs at the biological surface, which stimulates antibody and cellular immune responses, capable of activating both the innate and acquired arms of the immune system against a range of pathogens. In this manner, singlet oxygen and other reactive oxygen species generated by photodynamic action not only inactivate and decontaminate pathogens, toxins, poisons, and other deleterious dangerous substances but also serve to stimulate protective beneficial immune responses against said substances. In another embodiment the breakdown of pathogens or toxins or poisons by the action of light and at least one photosensitizer producing singlet oxygen and/or other reactive species occurs on a protective fabric suit which is proximate to a biological surface, generates immunogens which are inhaled, ingested, or contacted to skin, which lead to a beneficial protective immune response.

In another embodiment, methylene blue and/or other photosensitizers are combined with a reducing agent such as ascorbate, generating reactive species such as hydrogen peroxide, in the case of methylene blue and ascorbate, which further serves to decontaminate, disinfect, or otherwise render safer a biological surface or protective fabric. In yet another embodiment the ascorbate is provided in a slow release formulation such as is known in the art, which leads to a combination of effects such as simultaneous generation of hydrogen peroxide and singlet oxygen in lighted conditions, or hydrogen peroxide generation which can occur in dark non-lighted conditions. Light conditions can range from darkness to 50,000 lux, to full sunlight conditions.

In another embodiment, a two compartment or chamber spray bottle, such as is commercially available, is utilized, with one compartment or chamber containing at least one photosensitizer such as methylene blue, and the other compartment or chamber containing another reactant such as ascorbate. The spray from both compartments may be delivered simultaneously or sequentially in order, photosensitizer first, then the second reactant, or in reverse order, in an embodiment with two pump head triggers, each being fed from a different compartment or chamber by separate dip tubes (U.S. Pat. No. 9,931,656). In one embodiment a series of laboratory tests are performed against toxins, poisons, and pathogens in order to ascertain an optimal spray sequence of at least one photosensitizer and at least one reactant such as, but not limited to ascorbate, which generates an adequate amount and composition of reactive oxygen species such as but not limited to singlet oxygen and hydrogen peroxide, in quantities that provide optimal protection without damaging or degrading material substrates that they are applied to. Optimal spray pattern, droplet/mist size, and droplet/mist deposition speed are determined experimentally as well. Other reactants may optionally include citric acid, and/or acetic acid, and/or acidic fruit juices such as those derived from lemons, oranges, and the like. The various optional reactants, and/or the photosensitizers can be supplied as a powders, granules, pellets, capsules, tablets, and the like, either pre-loaded into the spray container, or supplied separately as part of a kit. In addition to a spray bottle, the combined solutions can be applied to fabrics and/or hard or soft surfaces, filter type materials, protective garments, headwear, face covers and masks, footwear, gloves, bandages, and the like, from sponges, sponge sticks, roll-on type of applicator devices, wipes, and the like, and/or sprayed into the air as an aerosol.

In yet another embodiment, protection against ionizing radiation is provided by the interaction of at least one photosensitizer, which are capable of absorbing ionizing radiation from radioactive sources, generating reactive species which are secondarily quenched. These types of quenching reactions provide protection of normal tissues by neutralizing reactive species generated by ionizing radiation, which would otherwise react with and damage normal cells and tissues.

Quenching agents include one or more of antioxidants and substances such as ascorbate, beta-carotene, lycopene, astaxanthin, alpha-tocopherol, polyphenols, vitamin A, Vitamin E, beta-carotene, glutathione, selenium, magnesium, coenzyme Q10, flavonoids, resveratrol, phenols, polyphenols, phytoestrogens, lycopene, lutein, zeaxanthin, astaxanthin, furfuryl alcohol, and the like, preferably generally recognized as safe substances and normally ingested substances, at concentrations ranging from 0.001 to 1000 micromolar utilized as quenching agents. In some embodiments, at least one photosensitizer such as methylene blue and/or riboflavin are applied topically to the skin, eyes, ingested, and/or inhaled in combination with at least one quenching agent, in combination or sequentially. The action of the photosensitizers are to absorb the radiation, producing singlet oxygen and/or other reactive oxygen or non-oxygen species which are rapidly quenched or scavenged, protecting normal cells and tissues.

In one embodiment, one or more quenching agents is co-mingled with at least photosensitizer and applied as a coating to the protective suit fabric, or to the skin, the eye surface, and/or the mucous membranes. The coating can be applied as a spray, or swabbed on in the event of a potential radiation exposure accident or deliberate attack.

In another embodiment, at least one photosensitizer taken internally into the body through ingestion, topical application, and/or injection serves as a radiation protectant by absorbing radiation from the radioactive sources followed by quenching of the reactive products. In one embodiment, photosensitizers known to be safe to ingest or inject intravenously or intramuscularly, or parenterally, are administered prior to expected radiation exposure, or after radiation exposure, with simultaneous quenching of the reactive species generated by the interaction of the ionizing radiation (alpha, beta, gamma, X-rays) with at least one photosensitizer. In another embodiment, at least one photosensitizer is applied as an outward facing layer or coating to a protective fabric or surface, or to the skin, with an undercoating of a quenching agent deep to the photosensitizer coating/layer, which serves to quench the radiation absorbing and activated photosensitizer layer generated reactive species, protecting the tissue layers underneath.

In one embodiment, dimethyl sulfoxide 0.1 to 60.0% range is combined with at least one photosensitizer such as methylene blue and riboflavin, as non-limiting examples, and a quenching agent and administered topically as a spray, a roll-on formulation, or in a patch leading to systemic absorption, due to the well known skin penetration properties of dimethyl sulfoxide, for the purposes of normal tissue protection from radiation injury or poisoning. In another embodiment dimethyl sulfoxide ranges below 0.1% or above 60.0% are used as a skin penetrant in combination with at least one photosensitizer and quenching agent.

In some embodiments, the slow release vehicles/substances used to deliver quenching substances over an extended duration include chitosan, hydrogels, waxes, cellulosic formulations, and a large number of various known polymers (Huang 2017, Adepu 2021). It is understood that a wide variety of slow release vehicles/substances have been developed and are included in the present disclosure. Slow release vehicles/substances are known, and include cellulosic formulations with methoxyl or hydroxypropyl side chains, waxes, acrylics, chitin substances, matrices incorporating lipids, minerals, and the like, polyvinyl alcohols, polyvinyl acetates, polysaccharides such as alginate, methacrylates, natural gums, polyethylene oxides, cellulose ethers, hypromellose, povidone, propylene glycol ethers, and other non-limiting substances developed for sustained drug release.

In some embodiments, protection of the skin and internal anatomic structures in the path of ionizing radiation, administered for therapeutic purposes or by accident are protected by methylene blue as a mono-agent, and/or at least one other photosensitizer, combined with at least one quenching agent, all of which are administered topically, and/or injected, in an immediate or sustained release formulation is used to protect normal tissues from ionizing radiation damage.

In some embodiments, methylene blue is administered topically to skin and/or mucous membranes, or injected internally, or applied to wounds for pain control.

In another embodiment the ionizing radiation protective photosensitizer/quencher formulation is applied rapidly to the outer surface of protective suit fabric using a spray bottle, and/or a sponge stick, and/or a roller, with the photosensitizer/quencher formulation contained in the handle, which is flowed and/or sprayed and/or swabbed onto the outer surface of the protective suit fabric. In yet another embodiment, the photosensitizer formulation is applied as one layer, followed by application of the quencher in a second layer, sequentially, with the photosensitizer deep or superficial to the quencher layer, with reapplication as needed depending on the degree and duration of the ionizing radiation threat.

In another embodiment, imbibing of liquids easily and safely is achieved by incorporating a protected water bladder within the interior or on the exterior surface of the protective garment or suit, which optionally contains a riboflavin and/or methylene blue or other safe, ingestible photosensitizer formulation which serves to decontaminate the water if accidental contamination occurs, and that provides a protective effect in the gastrointestinal tract and oropharyngeal tissue due to the dark reactions of, for example methylene blue, which can potentially treat organophosphate poisoning.

In another embodiment, an aqueous methylene blue formulation with low molecular weight hyaluronic acid is applied to hair bearing skin using a sponge stick with a hollow handle containing the formulation. In yet another embodiment a formulation containing riboflavin and high molecular weight hyaluronic acid is applied to skin using a sponge stick with a hollow handle. In another embodiment a riboflavin formulation incorporating hydroxypropyl methylcellulose is applied to the conjunctiva using an eye dropper bottle.

Other eye protective formulations contain one or more of:

Riboflavin 0.001 to 1000 micromolar concentration is included in the present disclosure.

Hydroxypropyl methylcellulose 0.001-1% range, though concentrations below or above are included in the present disclosure.

Propylene glycol 0.001-1% range, though concentrations below or above are included in the present disclosure.

Polyvinyl alcohol 0.001-1% range, though concentrations below or above are included in the present disclosure.

Carboxymethylcellulose Sodium 0.001-1% range, though concentrations below or above are included in the present disclosure.

Polyethylene glycol 0.001-1% range, though concentrations below or above are included in the present disclosure.

Hypromellose 0.001-1% range, though concentrations below or above are included in the present disclosure.

Glycerin 0.001-1% range, though concentrations below or above are included in the present disclosure.

In one embodiment, the protective suit or garment is or a one-piece design, which includes a hood for head and neck protection, and built-in gloves and socks, with a front zipper oriented vertically, as can be found in some wetsuit designs, with an overlapping strip of protective fabric which covers the zipper and is closed over the zipper with an adhesive, pre-applied to the undersurface of the flap, and protected prior to use by a nonstick peel-away backing as is used in conventional bandages. In another embodiment, the protective suit or garment is a two piece design, whereby one piece protects the lower extremities and waist, and the other piece protects the torso, head, and neck. In yet another embodiment, the protective suit or garment is a three piece design, with one piece protects the lower extremities and waist, the second piece protects the torso, and the third piece acts as a cowl that protects the head and neck. In these embodiments, an adhesive with a nonstick peel-away backing, located on the internal surface next to the skin, of a width of 0.5-2 inches, and circumferential in design, is used to create a seal to the openings of the suit/garment pieces, after donning prior to use. Wherever a reversibly sealed seam exists within the protective suit fabric, a flap incorporating at least one photosensitizer, of 1-2 inches in width, with an adhesive with a nonstick peel-away backing is optionally incorporated as an added barrier when adhered to the fabric, and covering the seam.

In another embodiment, methylene blue and/or riboflavin and/or other photosensitizers are added during the protective suit laundering and/or drying process. In this manner, the photosensitizer concentration on the protective suit is enhanced or renewed in the event of photobleaching, abrasion, or other processes which may degrade the protective performance of the suit. In one embodiment between 1-20 grams, of at least one photosensitizer in powder or granule form is contained in a dissolvable laundry pod whose coating is comprised of known dissolving substances such as polyvinyl alcohol. In this embodiment the laundry pod is added during the wash cycle when laundering the protective suit fabric, which renews the protective photosensitizer coating on the surface and within the substance of the protective suit fabric. In yet another embodiment at least one photosensitizer is incorporated into one or more dryer sheets and/or on the surface of one or more dryer balls in a range of 1-5 grams of dry photosensitizer which when added during the drying cycle, serves to renew the photosensitizer coating on the surface and within the substance of the protective suit fabric.

In another embodiment, the photosensitizer formulation incorporates a high concentration of at least one photosensitizer, above 500 micromolar, which also optionally contains indocyanine green (10 to 1000 micromolar concentration range), which can absorb light in the near infrared range, such that the suit still provides protection if incident visible light absorption by the suit is reduced by surface coating of dust, grime, mud, blood, or other substances. The incorporation of indocyanine green into the protective suit enables photoactivating light transmission producing singlet oxygen in the near infrared range, around 800 nm, which is known to penetrate opaque substances such as soil and sand (Woolley 1978, Baranoski 2019). The indocyanine green can also visibly fluoresce, enabling visual identification of an individual wearing the protective suit using a near infrared light source directed at the individual, in order to avoid friendly fire types of incidents, or for localization of the wearer of the protective fabric suit as may be needed for various purposes such as search and rescue types of operations.

In another embodiment, a removable protective fabric sleeve, containing or incorporating at least one photosensitizer, optionally held in an open position by a nitinol or polymeric ring at one end, is reversibly attached to the protective suit material externally, such as using a Velcro type of attachment, or contained within a pocket. At one end of the sleeve, which is held in an open position by the nitinol or polymeric ring incorporated into the end of the sleeve, the inner 0.5 mm to 2.5 cm of the sleeve is coated with known medical grade adhesive(s) such as silicones, acrylics, polyurethanes, cyanoacrylates, polyethylene glycols, and/or vinyl resins, with a non-stick backing strip protecting the adhesive till use, as is used in ordinary bandages. In one embodiment, this end of the sleeve is reversibly attached to the protective suit fabric such that the mouth of this open end encompasses an area or region of the protective suit which requires manual access, such as may be the case with a wound or injury, where the protective suit fabric may need to be cut open for access, or previously breached. The other end of the sleeve may incorporate an elastic band or a polymeric reversible tie, which can be tightened around an inserted upper limb, for example around the wrist or forearm, thus enabling continued isolation and protection of the exposed skin area deep to the cut or breached protective suit fabric. In this embodiment, manual access is enabled to control bleeding or perform other medical procedures while maintaining isolation of the treatment area from the environment, which may be contaminated.

In another embodiment, gloves which are hermetically sealed to the upper limb distal sleeves of the protective suit are comprised of any individual or combination of known high performance polyethylene, glass fibers, high molecular weight polyethylene, nylon, nitrile, neoprene, Kevlar or other similar materials, also known to be heat resistant, which can be used to create cut proof and puncture resistant or proof glove material. In another embodiment the glove material incorporates at least one photosensitizer, and is permeable to air, or impermeable to liquid. The glove material ranges in thickness from 1.0-3.0 mm, though ranges below or above this are part of the present disclosure.

In another embodiment, polymers incorporating at least one decontaminating and/or antimicrobial photosensitizer such as methylene blue and riboflavin, and biodegradable/compostable polymers synthesized from corn, potato, tapioca starches, cellulose, soy protein, polylactic acid, and the like are utilized to manufacture eating utensils, plates, bowls, cups, and food storage containers that are antimicrobial. Though polyethylene/polyolefins can be used in this embodiment, with photodynamic dyes incorporated during processing, biodegradable/compostable polymers for utensils, tableware, and food/liquid consumables storage containers, such as polylactide are preferred, and are produced by injection molding, heat forming, extrusion, and similar known production methods, with photodynamic dyes such as methylene blue and/or riboflavin incorporated in aqueous or powder form at one or more steps during the processing. Concentrations of at least one photosensitizer can range from 10 micromolar to 1000 micromolar, or up to 1% (w/v). In some embodiments a plasticizer such as water, glycerin, urea, polyethylene glycol, citric acid, or sorbitol is also used as part of the manufacturing process.

In another embodiment, a number of commercially available water repellent finishes for fabrics based on silicones, waxes, and the like are combined with at least one photosensitizer such as, but not exclusively methylene blue and/or riboflavin, with the option to incorporate known dispersing agents or known carriers that aid in incorporation of at least one photosensitizer into the water repellent substance, which is applied to the surface of the fabric or textile as a spray, or as a liquid during the manufacturing or the textile or fabric.

In yet another embodiment, a multilayer fabric is created from a polypropylene and/or other polymers or natural fibers known to utilized for viral, pathogen, or particle trapping and filtration. Polymers can also include polyester, polyethylene, polyacrylonitrile, polycarbonate, polystyrene, polyvinyl chloride, polyamide, nylon, polylactic acid and the like. Natural fibers can also include cotton, wool, silk, other cellulosic materials, and the like. In some embodiments these filter materials are embedded with at least one photosensitizer such as methylene blue and/or riboflavin during manufacture, using known dip and nip techniques, knifing techniques, sublimation techniques, dispersal agents, methanol, supercritical carbon dioxide, jet spraying, dye printing, and other established dyeing techniques. In one embodiment, an outer layer is comprised of a cotton or other cellulosic material that is between 0.1 millimeter to 5 millimeters thick, incorporating at least one photosensitizer, and an inner layer of polypropylene which is optionally meltblown, optionally incorporating at least one photosensitizer, with a thickness between 0.1 millimeter to 5 millimeters. A variety of known adhesives and/or thermal and/or mechanical techniques can be used to adhere the layers together, or the fabric layers can be separate and not bonded. Needle punching, hot calendar rolls, gravure bonding, adhesive resins, epoxies, urethane adhesives, cyanoacrylates, and other known fabric glues can be used to bond fabrics together. In some embodiments, the fabric is used to construct bandages, protective clothing, garments, hats, caps, hoods, sleeves, chaps, gaiters, face coverings, shoe covers, socks, gloves, aprons, and the like. In other embodiments, drapes, sheets, pillow cases, towels, wipes, and other high touch and cleaning fabrics are created. In bilayer or multilayer fabric compositions at least the outer facing layer incorporates at least one photosensitizer, and/or metals with known antimicrobial properties such as silver, or copper, or zinc, or titanium dioxide particles. In one embodiment, the outer photoactive layer disinfects and kills pathogens while the inner layer also serves to trap pathogens, acting as a form of source control. In other embodiments, the fabric layers are air permeable, breathable, or fluid repellent or fluid resistant or water proof.

In one embodiment, a protective fabric consists of at least one layer of porous fabric incorporating at least one photosensitizer and/or other substances capable of neutralizing pathogens, toxins, poisons, radioactive particles, and the like that are in the ambient environment surrounding the user of the protective fabric. For example, the fabric may be fashioned into a pouch or pocket or compartment incorporated into the protective suit, uniform, clothing worn by the user. Preferentially, but not exclusively, the pouch or pocket is incorporated or attached to the torso of the protective suit, uniform, or clothing, contiguous with at least one tube or duct or channel which transfers air which has passed through at least one layer of protective fabric used to create the pouch or pocket. The air transfer component is impermeable to ambient air, and can be comprised of a flexible polymer or plastic, which further incorporates at least one photosensitizer and/or other substances in the interior lumen of the at least one tube, duct, or channel, capable of neutralizing pathogens, toxins, poisons, radioactive particles, and the like that are in the ambient environment.

As the user inspires air from the ambient potentially contaminated, toxic, or poisonous environment, the air passes through at least one protective layer, and then through at least one tube, duct, or channel which directs the decontaminated or threat neutralized air towards the face of the user, where it is inhaled. Exhaled air can pass through a one way valve incorporated into the construct in front of the user's face, which may be a face cover, mask, face shield, and the like. The one-way valve permits treated decontaminate or threat neutralized air to be exhaled, while preventing the user from inhaling untreated air directly from the ambient environment. The pouch, pocket or compartment may be comprised of two porous, breathable surfaces, or one nonporous surface which is inward facing and one porous breathable outward facing surface which admits air. In all cases, all air contacting surfaces are coated with and incorporate at least one photosensitizer and/or other substances capable of neutralizing pathogens, toxins, poisons, radioactive particles, and the like that are in the ambient environment.

In another embodiment, at least one photosensitizer in a solution or in a dry form is dispersed into the air or environment in an area suspected of, or actually contaminated by a pathogen or radioactive substance. Dispersal can be accomplished using a sprayer type of device (manually or battery powered), or a smoke generator type of device incorporating a propellant, or an explosive type of device for extremely rapid and widespread photosensitizer dispersal. A safe, non-toxic, photosensitizer such as, but not limited to riboflavin can be used, as an example, which absorbs radiation or interacts with a pathogen in the air, or on a surface, or on equipment, which can react with light generating reactive oxygen species and/or singlet oxygen, which inactivates or kills the pathogen, or when interacting with a radioactive substance in the air, on a surface, or on equipment, is quenched, reducing or elimination the radioactive threat.

In another embodiment, the environmentally dispersed photosensitizer is initially in an aqueous formulation, a lipid or oil based formulation, or in a powder form, prior to being dispersed. The dispersed droplet or aerosol size, speed of deployment, volume of deposition, droplet or aerosol fall rate, and airborne concentration and surface contact concentration is experimentally determined and optimized for various environmental conditions, such as still air, wind, rain/fog, variable humidity, and the like, in a laboratory setting, using known equipment and techniques known in the art, such as particle counters and particle size measuring equipment. Aerosol or droplet size can range from 1 nanometer to 1.5 millimeters and in concentration, from 1 part per million to 900,000 part per million.

In another embodiment, a system of multiple neutralizing modalities and are tested and deployed, comprising air disinfection and decontamination, remote to persons or animals or plants and objects or equipment to be protected, an air disinfection and decontamination device(s) used in close proximity to persons, animals, equipment and the like, wearing of fabric that acts as personal protective equipment, and protection of the airway and orifices.

For neutralization and decontamination of air proximate to persons and/or animals, or to decontaminate air the contacts surfaces, objects, and/or equipment, one or more fan devices which incorporate a photoactivating light source, and internally disposed photosensitizer activated by said light, are utilized to inactivate pathogens in the air, or absorb and quench radioactive particles by way of the known quenching mechanisms of singlet oxygen and other reactive oxygen species generated by the interaction of ionizing radiation and photosensitizers.

In one embodiment, a fan device is comprised of an axial type of fan within a tube, located at the distal end or proximal end or middle section of the tube. The interior of the tube incorporates a layer of at least one photosensitizer, with a thickness ranging from 1.0 micron to several millimeters thick or more, and a concentration ranging from 0.1 micromolar to 1.5 molar or greater. In another embodiment the fan blades are coated with at least one photosensitizer, and a light source preferentially, but not exclusively battery powered is incorporated which photoactivates the interior photosensitizer coating. As air passes through the fan device, pathogens and radioactive particles are inactivated by way of singlet oxygen and reactive oxygen species followed by quenching. In one embodiment the fan device housing is optically clear, which augments the photoactivation process using ambient light. In another embodiment, a non-toxic quenching agent is expelled into the air after the photosensitizer is dispersed into the air, augmenting the naturally occurring quenching processes in air. In another embodiment the quenching agent expelled into the air and environment after photosensitizer dispersal is comprised of a water vapor droplet or aerosol formulation.

In another embodiment, a visible to the naked eye aerosolized dye marker is included in the formulation dispersed in the air, in order to monitor the location and movement of the aerosol/droplet cloud after dispersal.

In yet another embodiment, a protective breathable face cover is worn by a person or animal to be protected that incorporates an outer layer of at least one photosensitizer formulated into a dry powder that is applied upon detection of an airborne pathogen or contaminant, or that is manufactured into the fabric. The photosensitizer formulation is such that an amount of photosensitizer is released into the air anterior to the face cover with exhalation by the user of the face cover or mask, which provides an additional decontaminated protective space in front of the user prior to inhalation. The quantity of photosensitizer released into the air is adjusted and optimized in a series of experiments such that an amount of sensitizer is released that is effective over a period of time due to retention of another amount of sensitizer on the face cover surface. Inhalation of the photosensitizer on the surface of the face cover or mask is precluded by the use of known filter materials deep to the photosensitizer layer.

In one embodiment, one or more photosensitizers which reflect different wavebands of visible light are combined in varied concentrations in solution or in a relatively dehydrated state to create a palette of colors as desired for purposes of camouflage, attractiveness, high visibility for safety purposes, to convey feelings or messages by way of various designs and patterns. For example, methylene blue as a fabric dye imparts a blue to purple color on a white cotton or artificial polymeric or blended fabric, with the shade ranging from light to dark, depending on the concentration. Riboflavin which can be supplied as a yellow powder combined with methylene blue powder, in a fluidic solution will create various shades of green, as a fabric dye. Combining rose bengal and/or erythrosine which have a pinkish hue with methylene blue and riboflavin can create a dark, mottled green or brown colored fabric dye as a further non-limiting example.

In one embodiment, the photosensitizer concentrations range from 0.001 micromolar to 2000 micromolar, or from 000.1% weight/volume to 2.0% weight/volume. In another embodiment the color of the photosensitizer combination in ambient light is adjusted using a color matching chart or an app, such as can be done for matching paint colors. In another embodiment all types of known disperse dyes of various colors and hues are also combined with photosensitizers to create various colors. In another embodiment known dispersal agents are used in combination with photosensitizers to enhance color fastness.

In a variety of embodiments photosensitizers as a single or in combination used as a fabric dye can inactivate microbes and volatile organic compounds to reduce or obviate infection risks and for purposes of odor control.

Though many photosensitizers such as methylene blue were synthesized as a fabric dye, the present invention optionally includes the use of known or contemplated disperse dyes and compounds, such as soda ash (as a nonexclusive example), as a color fixative, and to enhance color fastness if desired, or as needed.

In another embodiment, ultraviolet (UV) light absorption for sunburn skin protection is enabled, non-limiting examples of which include methylene blue which is associated with an absorption waveband in the UV as is riboflavin and most other known photosensitizers.

Bright colors are known to attract insects such as mosquitoes and the present invention unexpectedly acts as a mosquito repellent in another embodiment, despite the display of bright fabric colors, due to generation of singlet oxygen and reactive oxygen species well known to be generated by photosensitizer light absorption.

Thermal energy absorption may be enabled by using indocyanine green as a heat dissipation element-cooling when irradiated by external heat source in ambient light, and cooling of skin when skin is emitting near infrared radiation (NIR)/infrared radiation (IR) radiation.

Methylene blue as well as other known water soluble photosensitizers are hygroscopic and may improve wicking of sweat which also reduces physiologic heat load and heat perception.

In another embodiment, a fabric, cloth, hard or soft surface, natural or synthetic fiber, cutaneous surface, mucous membranes and the like incorporates an activated carbon or activated charcoal formulation, applied during manufacture, or on biological surfaces as a spray or wipe, or as a swallowed liquid.

Activated carbon with specific surface area ranging from about 2000-2500 m2/gm and micropore volume of 1.6 ml/gm or more, or less, are part of an fabric and/or spray formulation embodiment for surface, fabric, equipment, and air and environmental decontamination. As an air decontamination procedure, an activated carbon powder or granule formulation can be sprayed or dispersed into the air, followed by filtration and/or capture by known filter materials, incorporated in fans or related air circulation devices, in personal protective equipment (PPE) and masks, and the like.

Applied using a dip, spray on, wipe, sponge, or other related application methods, fabrics, garments, PPE, equipment, hard and soft surfaces, and the like can be imbued with activated carbon with or without at least one photosensitizer formulation in combination, with the activated carbon admixed with the photosensitizer, or applied separately in any sequence.

In another embodiment, in combination with at least one photosensitizer, admixed with the activated carbon or activated charcoal formulation, or disposed as a separate layer superficial or deep to the activated carbon or activated charcoal formulation, used on fabrics, garments, PPE, equipment, hard and soft surfaces, and the like.

In addition to activated carbon substances, other known and contemplated absorbents would include silica gel formulations, and active alumina, as non-exclusive examples, in combination with at least one photosensitizer, for hard and soft surfaces, equipment, devices, PPE of all types, and in air, for decontamination purposes. In yet another embodiment, toxins, pathogens, poisons, malodorous compounds, and other noxious chemicals, biochemicals, and the like are captured and trapped not only by activated carbon, silica gel, active alumina and related compounds applied to fan blades, filter material, hollow tubes, pipes conducting air to be purified and disinfected.

In one or more embodiments, a thin flexible medical grade optically clear silicone elastomer consisting of known polymers and crosslinkers is molded or cut into pieces and glued or bonded into a configuration that fits comfortably around the nose and mouth, as a one piece naso-oral construct, held in place with ear loops or straps, or using known medical grade adhesives such as those used for removable wound dressings and bandages, enabling many hours of comfortable wear. In one embodiment, the outer rim of the one piece construct follows and adheres to the cartilaginous portion of nose, continuing inferiorly following and adhering to the nasolabial fold or adjacent tissue, continuing and adhering to the lateral commissure or adjacent lateral tissue, and continuing and adhering just inferior and below the lower lip, creating a comfortable reliable seal that can last for hours to days, around the nose and mouth. In another embodiment the upper portion of the construct is glued or otherwise bonded to the lower rim of a pair of glasses, goggles, or similar eyewear. One or more flexible polymeric medical grade tubing, of which many grades are commercially available used for intravenous injections and air delivery, which is optionally corrugated and/or contains multiple intraluminal baffles incorporating at least one photosensitizer and optionally at least one light source, and optionally at least one polymeric focusing lens directing light into the construct and/or tubing, is joined or bonded to the naso-oral construct. Tubing parameters such as length, diameter, shape, configuration, internal surface shape, transparency, photosensitizer concentration, disposition, and the like are optimized for expected environmental conditions, air quality and the like, using known laboratory techniques which can assay microbial, pathogen, toxin, poison, and radiation contamination. An optional air filter of which many types are commercially available is optionally incorporated at either or both ends of the tube, or located internally along a portion or the entire length of the tube.

In another embodiment, body heat generated by normal cellular metabolic processes and muscle contraction is captured by clothing, garments, body worn coverings and the like and transferred to ambient air proximate to the anterior aspect of the torso, neck, and other body parts. In relatively still indoor air, the captured and transferred heat to the air anterior to the body rises towards the mouth and nose, as well as the eyes and face. In this embodiment, the clothing, garments, body worn coverings and the like incorporate at least one photosensitizer, and utilize at least one light source that induces photoactivation processes that decontaminate the air which flows proximate to the user's mouth and nose where decontaminated air is inhaled and exhaled, and at the same time, the air curtain also protects the eye surfaces from pathogens and toxins.

In another embodiment, objects and surfaces proximate to the user can also incorporate at least one photosensitizer which can decontaminated air proximate to the user's face as well. In this embodiment, at least one photosensitizer can be applied as a spray to objects and surfaces proximate to the user, or incorporated into transparent thin films, optionally comprised of known polymers, applied reversibly or permanently to objects and surfaces proximate to the user, preferably but not exclusively located anterior to the user, for the purpose of decontaminating inhaled and exhaled air, and protecting the eyes and face of the user.

In another embodiment, head or neck worn jewelry, glasses, and other types of eyewear, can also incorporate at least one photosensitizer and provide added air proximate to the user's face that is decontaminated.

In another embodiment, hats, caps, visors, helmets, head worn gear and the like, which may or may provide a brim anterior to the user's forehead are cooled, causing air superior to the user's face to sink, where it can protect the user's eyes, and be inhaled and exhaled.

In one or more embodiments, cooling methods, techniques, and devices may optionally be incorporated into the decontamination tube device. In another embodiment, the disinfecting device is rectangular or share, or oblate in cross section.

In another embodiment, high molecular weight polyethene fibers and yarns with high strength, cut resistance, and excellent heat transfer capabilities are used with incorporation of at least one photosensitizer, and/or activated carbon and/or antioxidants such as but not limited to ascorbate to create a fabric with high absorptive capacity for toxins, pathogens, poisons, neutralization of ionizing radiation and other threats to health.

In another embodiment, essential or aromatic oils containing photoactive substances such as but not exclusively bergamot, citrus oils, limonene, or their known photoactive components and the like are diffused or aerosolized into the air and photoactivated by at least one light source.

In another embodiment, the essential or aromatic oils are applied or deposited on any hard or soft surface, whereupon diffusion into the air can occur, and when photoactivated by at least one light source, generating photoactivation products such as singlet oxygen and/or other reactive oxygen species on surfaces, and in the ambient air.

In one embodiment, the essential or aromatic oils are applied to fabric used to fashion clothing, garments, scarves, neckwear, hats, face protectors, helmets, and any flexible or rigid fabrics, generating singlet oxygen and/or other reactive oxygen species, which inactivates and kills pathogens, toxins, poisons and the like. In another embodiment, all types of hats and visors incorporating a brim anterior to the user's forehead incorporates at least one photosensitizer and/or photoactive essential oil with an optional fan or blower as part of the headwear, neckwear, clothing, garments, and the like which aids in shunting decontaminated, treated air towards the user's face, where inhalation of decontaminated air can occur. In another embodiment, high molecular weight polyethylene known to conduct heat from the body surface to the environment, incorporating at least one photosensitizer, generates a heat driven rising air current towards the user's face with or without the added use of headwear with a brim incorporating a phase change material which cools proximate air, generating a volume of sinking air anterior to the user's face. In this way, decontaminated air is passively directed towards the user's face for inhalation. In another embodiment, the hard or soft surfaces, and/or clothing, garments, headwear, neckwear, and the like also incorporate activated carbon with or without at least one photosensitizer, for absorption of toxins, poisons pathogens, and the like.

In another embodiment, a skin adherent polymeric thin film incorporating at least one photosensitizer which is optionally of the volatile type can be applied to the facial area around the mouth and nose, creating a zone of decontaminated air for inhalation when photoactivated.

In another embodiment, a volatile oil is admixed with at least one photosensitizer and applied or incorporated into soft and/or hard surfaces, thin films, clothing, eyewear, glasses, goggles, garments, head wear, scarves, neckwear, helmets, hats, visors, and the like. When photoactivated by at least one light source, air in proximity is decontaminated for inhalation. In another embodiment, an air disinfection device is comprised of a rigid or flexible polymeric tube, which is created with baffles, and/or corrugations, which enable greater surface area for incorporation of at least one photosensitizer, and with optional incorporation of least one light source which serves to photoactivate the photosensitizer within the air disinfection device. In another embodiment, one end of the tubular air disinfection device incorporates an active or cooling feature, and the other opposite end of the tubular air disinfection device contains a heating feature which is active or passive.

For one or more embodiments, exemplary cooling features may include: Passive cooling that may be accomplished using a phase change substance such as, but not exclusively a paraffin, polyethylene glycol, and the like. Another exemplary embodiment of a cooling method/technique can employ evaporative cooling using a liquid such as a water reservoir at one end of the air disinfection tube with or without a fan which with a fan, can provide for an active cooling mechanism as the fluid which may be water evaporates.

One or more exemplary embodiments of heating features may include known, commercially available air activated products incorporating cellulose, iron, activated carbon, vermiculate, and salt, as a non-exclusive example, which induces an exothermic reaction. In another embodiment, cool air is drawn into the inlet of the air disinfection device which is decontaminated in the interior of the tube and ejected or flowed out of the other end of tube from active or passive heating of the decontaminated air, creating a zone of decontaminated air which disperses into the environment.

In another embodiment, a warming technique/mechanism consisting of known, commercially available crystallization based reusable warmers, which may be comprised of a sealed container or pocket of chemicals in the form of a supersaturated sodium acetate solution incorporating a metallic chip. Upon flexing or bending the metallic chip, a reaction occurs at the metallic surface and the solution crystallizes, releasing heat. Reuse is enabled by applied heat for example using hot water which dissolves the crystals again.

In another embodiment, a portion of the tubular air disinfection device is comprised of a transparent or optically clear polymer, which may be rigid or flexible, or a combination of both, which admits ambient photoactivating light to the interior of the tubular air disinfection device, which may incorporate at least one photosensitizer along a length of the tube, in the lumen and/or extraluminally. In another embodiment, a flexible elongate air disinfecting polymeric tube is incorporated into clothing, garments, face covers, masks, eyewear, scarves, headwear, helmets, and the like, and may optionally incorporate at least one light source, or be positioned externally to the environment such that ambient light is admitted to at least one portion or the entire length of the tube. In another embodiment, the variable such as tube length, shape, dimensions, configuration, internal photosensitizer concentration, disposition, optional cooling and/or heating mechanism are optimized for various expected environmental conditions using known laboratory techniques such as antimicrobial testing, air flow testing and the like.

In another embodiment, the Venturi effect/Bernoulli principle may be exploited in design of a constriction at the heated or warmer end of the decontamination tube to direct an air stream in a desired manner, such as towards the user's face where inhalation occurs. Additionally, in another embodiment, any or all of the above embodiments may be combined.

In one or more fabric embodiments, clothing or garments, headwear, helmets, hats, gowns, shirts, pants, scarves, and the like, incorporate at least one photosensitizer, and optionally at least one light focusing lens, which directs ambient light or light from a discrete light source such as a light emitting diode array, directly onto at least one optically transparent tube with is incorporated into the fabric of the garments, headwear, gowns, shirts, pants, and the like. The optically transparent tube, or multiple spaced apart tubes, may be located under or external to the fabric, or in both locations, and may be comprised of an optically clear polymer, which optionally acts as an optical fiber as is known in the art, capturing, and transmitting light along the length of the tube which may incorporate at least one photosensitizer. One end of the tube, which is defined as the distal end of the tube in the present disclosure, terminates proximate to the nose/mouth area, and/or eye area, by optionally wrapping around the ear, or optionally by extending from the neck area towards the corners of the mouth and/or pointing towards the nares or nostrils of the nose. The fabric is optionally comprised of a breathable film or material, woven or nonwoven, incorporating at least one photosensitizer, with the polymeric tubes arranged to entrain/capture ambient air that has passed through the fabric layer, and decontaminated and treated by the photosensitizer/light photodynamic action, generating singlet oxygen and other reactive oxygen species, with air directed passively into the tubing by using body heat or a chemical warmer system proximate to the distal end of each tube and/or actively, using a small portable, rechargeable fan or blower incorporated into the proximal or middle segments of the tubing, of which there may be multiple. The chemical warming system may optionally be comprised of sodium acetate which is in a supersaturated aqueous solution that can be reused, or a single use system as is well known in the art of manufacturing and using chemical hand warmers, such as those comprised of iron powder, water, salt, activated charcoal, and vermiculite. In one embodiment contaminated air that is decontaminated by passage through fabric and tubing incorporating at least one photosensitizer, is warmed at the distal end of at least one tube, whose distal end is proximate to the nose/mouth area, and/or eye area, where inhalation of decontaminated treated air occurs as air rises in a plume proximate to the face.

In an embodiment, a polymeric tube(s) are perforated along the length of the tube(s) which enable passage of decontaminated, treated air which has passed through the fabric from the outer fabric surface to the inner fabric surface, for inhalation and exposure to the eye surfaces. In this embodiment, warmed air rises within each tube, driven by body heat or by at least one chemical warming system and is fed into eye protective glasses, goggles and the like.

In another embodiment, the distal portion of air tube(s) are incorporated into the torso garment or shirt or jacket neck or cowl. In another embodiment, at least one tube is able to elongate by way of a telescoping mechanism and design.

In yet another embodiment, contaminated air warmed and decontaminated by the body clothed or covered by fabric incorporating at least one photosensitizer, rises passively due to the typical ambient temperature difference, proximate to the face of the wearer, for inhalation and facial protection.

In another embodiment, the fabric incorporating at least one photosensitizer is produced/manufactured/created by dipping or spraying the fabric in a formulation containing at least one photosensitizer, the formulation containing a liquid component that solubilizes at least one photosensitizer, which may further optionally contain binding agents or dispersing agents, other dyes, known in the fabric dyeing art. Pressure from 1 to 10 bar or greater is optionally applied using rollers, and/or steam pressure, and heat from room temperature to up to 140 degrees C. is optionally applied by way of a temperature controlled container or vat, or oven as can be performed in an adjustable manner by commercially available fabric dyeing machines and devices and equipment. Fabric speeds as it passes through the dyeing equipment can reach up to 300 meters/minute.

In antimicrobial and decontamination natural and/or synthetic fabric and textile embodiments, methylene blue, riboflavin, at least one other photosensitizer, excipients that improve or enhance photosensitizer function, other types of known fabric dyes and coloring agents, binders, and other substances used to help with dye incorporation into fabric, disperse dyes, antimicrobial agents such as metals including silver, copper and the like, antibiotics of all classes used to combat infections and the like, are combined individually or in any combination with known and commercially available "wash-in" or spray applied water repellents including brands such as Nikwax, Gear Aid Wash-in, Revivex, 303 Fabric Guard, Nanoman water repellent, various silicone formulations, fluorocarbon/fluoropolymer/fluorochemical/formulations, wax formulations, and the like. In any case, the water repellent substances are combined with other agents/substances listed above with antimicrobial and decontaminating properties for incorporation into textiles and fabrics.

For example, in one or more embodiments, a formulation of commercially available Nikwax combined with 0.001 to 1% methylene blue in aqueous or powder form can be sprayed, wiped, sponged, or otherwise applied using any of the known fabric dyeing techniques onto fabrics or textiles, and/or added to a washing machine or liquid agitator container for adding or renewing water repellency to fabrics and textiles, along with incorporation of antimicrobial and decontaminating substances.

In another embodiment, a fabric, which may be woven or non-woven, breathable, or non-breathable, is fashioned from fibers, yarns, threads, and the like, dyed with at least one photosensitizer, is subsequently sprayed with a water repellent formulation also incorporating at least one photosensitizer, essentially locking in the photosensitizer already in the fabric substance. A feature of this embodiment renders the fabric more resistant to photosensitizer leaching from the fabric layer during washing of the fabric and reduces fiber loss from the fabric itself from washing or abrasion of the fabric. The added photosensitizer in the outermost water repellent layer which is washed-in or sprayed, or applied with a wipe or sponge, or a squeegee, to the dyed fabric also reduces the impact of photobleaching due to the added concentration and volume of photosensitizer in the fabric/water repellent construct. In another embodiment, the construction of the fabric in its entirety is manufactured using 3-d printing processes known in the art.

In another embodiment, the fabric is manufactured with a pattern of small optically clear polymeric discs, 0.1-10 millimeters in diameter, which may act as a lens, or optical diffuser, spaced apart, spaced intermittently, at 3 to 50 millimeter intervals, in a grid pattern, which serve to admit and disperse light to the underside of the fabric when worn proximate to the skin, scalp, body surface, or body orifices. Transmitted light in this embodiment can photoactivate at least one photosensitizer previously applied to the skin surface, body surface, scalp, or body orifices, hair, lips, face, eyes, and the like, or to the underside of the fabric incorporating at least one photosensitizer.

In another embodiment, dark or very low light level photoactivation of at least one photosensitizer is enabled by various combinations of the known classes of photosensitizers, in different or various concentrations, with or without excipients and substances that improve or enhance photosensitizer function.

For example, in one or more embodiments, 0.001 to 1% methylene blue in powder or aqueous formulation is optionally combined with any other photosensitizers in similar concentrations, with or without reducing agents such as ascorbic acid, with or without oxidizing agents and the like.

In another embodiment, layers of dyed or otherwise treated antimicrobial and decontaminating fabrics, polymeric filters natural or synthetic, supporting layers of materials, providing some degree of rigidity or reducing multilayer fabric deformation are bonded together using known dental adhesives and dental curing agents, epoxies, and resins, known dermal bonding agents and adhesives, such as commercially available Mastisol, Dermabond, other benzoin derivatives, cyanoacrylates, some of which rely on light illumination as a curing mechanism. In another embodiment, the known bonding agents, dental adhesives and dental curing agents, epoxies, and resins, some of which rely on light illumination as a curing mechanism, are combined with at least one photosensitizer, dyeing agents, or other excipients and substances listed above. The bonding pattern can encompass the entire fabric or other layer surfaces, or be applied in a spot pattern.

In another embodiment, drapes, fabrics, films and the like, with embedded photosensitizer(s) can be used as a liner or cover, enabling non-contact decontamination and prevention of contamination by a non-adherent fabric or film, by singlet oxygen and other reactive oxygen species diffusing into air proximate to the object to be protected by the drapes, fabrics, films. In another embodiment, synthetic polymers or natural fibers and the like incorporating at least one photosensitizer are fashioned into gloves with the option of applying water repellent containing at least one photosensitizer to the material before or after shaping or creating the glove construct.

BRIEF DESCRIPTION OF VARIOUS EXAMPLES OF EMBODIMENTS

Example 1

A riboflavin/high molecular weight hyaluronic acid formulation is rapidly applied to the skin surface using a sponge swab or roller or brush, wherein the handle contains at least one photosensitizer. A sponge swab or a roller with a hollow handle is also used to apply at least one photosensitizer to the external surface of protective fabric of the suit.

Example 2

Laboratory testing is utilized to determine and optimize at least one photosensitizer concentration and formulation which is incorporated in a protective fabric or film, or sprayed or applied by swabbing or brushing on the protective fabric, which is maximally protective against a range of pathogens, toxins, poisons, and radiation particles. Laboratory testing may use various types of known analytic methods, techniques, equipment, such as, but not exclusively, Raman spectroscopy, mass spectrometry, chromatography, and the like to characterize the uptake of at least one photosensitizer into and onto the protective fabric, followed by inactivation testing using known toxins and poisons or surrogates, and pathogen killing using known pathogens or surrogates, in vitro and in vivo, and optional chemical testing for reactive species. Known photobleaching, abrasion testing, laundering and drying, as non-exclusive tests are also performed in order to characterize protective capabilities during simulated use, and in field and actual use, which helps to optimize photosensitizer application and incorporation parameters, as well as optimize inclusion of other protective substances into and onto the fabric.

Example 3

Utilizing known laboratory testing techniques, at least one photosensitizer and at least one quenching agent are tested on skin surfaces, and on internal organs to determine the optimum formulations for normal tissue protection against ionizing radiation.

Example 4

A dirty bomb explosion or accidental radiation release event occurs in a combat zone or in an urban setting. Upon detection of the event, countermeasures are deployed consisting of launching of multiple photosensitizer containing canisters, which after launching to a pre-determined height and distance, rapidly release the photoactive droplets into the air. The radioactive particles emit radiation as they decay, activating the photosensitizer molecules which in turn generates singlet oxygen and other reactive oxygen species, which are rapidly quenched, in essence neutralizing the radioactive emission.

A quencher such as water vapor can also be deployed, followed by repeated deployments of photosensitizer droplets/aerosols in order to continue the decontamination process as needed. In addition, all surfaces, equipment, objects and the like can be sprayed repeatedly with the photosensitizer solution with optional repeated quenching using water solutions as an example, to achieve decontamination.

Additional decontamination can be accomplished by using a fan or filter incorporating a light source which employs a photosensitizer that decontaminates air proximate to persons. A decontamination photosensitizer can be applied to fabric, clothing, materials, worn or used by persons as well. Breathable nets or screens or nonbreathable films incorporating photosensitizers can be deployed surrounding persons and equipment that require protections as well. A non-toxic formulation of riboflavin and high molecular weight hyaluronic acid can be used on the skin for decontamination purposes in addition.

Example 5

In a series of laboratory-based experiments and studies, a variety of photosensitizers and quenching agents are tested in varying concentrations and dispersed into the air, and sprayed or otherwise applied to surfaces and equipment, in order to ascertain optimal speed, volume, timing, and droplet/aerosol diameter, in relationship to air movement and humidity. Neutralization of surrogate pathogens and contaminants released into the air can used in air chamber experiments, in vivo and in vitro to determine optimal formulations and release and dispersal modes and equipment used for environmental dispersal.

In another embodiment, at least one photosensitizer or photosensitizer combination such as methylene blue, riboflavin, and the like are sprayed as an aqueous solution or as a powder to an activated charcoal/carbon powder or coating, in order to combine the effect of pathogen/toxin/volatile organic compounds (VOC)/malodorous substances and the like, capture by activated charcoal/carbon with the photoactivation decontaminating/neutralizing effect of at least one photosensitizer. The activated charcoal/carbon is prepared by known methods including heating, oxidation, using known chemical activators, and the like, with pore sizes ranging from 1 nanometer to 5000 nanometers, and a surface area of 200 to 8000 meters squared per gram, prepared using known methods as a powder, as granules, in pellet form, from wood, coal, peat, olive pits, peach pits, corn cobs, bamboo, rice hulls, soybean hulls, leaves of various sorts, nutshells, and the like. The combination of activated charcoal/carbon and at least one photosensitizer is tested in the laboratory and in field testing environments to optimize the ratio of activated charcoal/carbon concentration and particle size to photosensitizer concentration, in terms of speed and completeness of decontamination and photosensitizer photobleaching rates, and pathogen or toxin capture or VOC absorption by the activated charcoal formulation.

In one embodiment, the combination of at least one photosensitizer and the activated charcoal/carbon formulation is applied as a spray, using a wipe, a sponge, or a roller, and the like, to a fabric, filter material for air or liquids, a suit, a surface, a face cover, a helmet, equipment, and any surface in need of a protective feature. In another embodiment the non-toxic photosensitizer, such as but not limited to riboflavin/activated charcoal/carbon formulation is applied to the skin surface, a mucous membrane surface, or ingested. In another embodiment, the activated charcoal/carbon and photosensitizer formulation are embedded in fibers using known methods. In all cases, the photosensitizer can optionally be activated by a light source in order to kill, inactivated, or decontaminate pathogens and toxins, VOC and the like, that are absorbed by the activated charcoal/ carbon formulation, by photoactivation, or activation using ultrasound, microwave, ionizing radiation, or by direct chemical interaction.

Example 6

In one experiment, a nylon/cotton blend material with a weight of 5.87 oz per square yard was dyed with 1% methylene blue in an aqueous solution, at a sublimation temperature of 121 degrees C. temperature, yielding a pickup of 70%. Tested fabric samples incorporated a range of 0.02-0.06 gm of methylene blue per square yard.

In another experiment, a 1% methylene blue solution was brought to a boil, at 100 degrees C., removed from heat and the nylon/cotton fabric soaked for 60 min. Methylene blue was incorporated into the fabric in a range of 0.01-0.07 gm of methylene blue per square yard.

In more experiments, nylon/cotton fabric was sublimated at 205 degrees C.) for 40 seconds, and in yet another experiment, a jet dye cycle involving agitation at 140 degrees C. and a pressure of 2 bar for 60 min yielded a similar range, of 0.01-0.07 gm of methylene blue per square yard.

What is claimed as new and desired to be protected by Letters Patent of the United States is:

1. A fabric product obtained by the use of a process, comprising:

determining one or more of a concentration or a formulation for one or more photosensitizers having antimicrobial properties;

applying the one or more photosensitizers to one or more inner surfaces of the fabric product;

incorporating a plurality of optically transparent lenses in a pattern into the fabric product to admit ambient light to the inner fabric surfaces proximate to a skin layer of a user; and configuring one or more inner surfaces of the fabric product as a protective barrier for the user of the fabric product, wherein light activation of the one or more photosensitizers protects the user against a range of pathogens, toxins, poisons, microbial particles and radiation particles incident on the one or more inner surfaces of the fabric product.

2. The fabric product of claim 1, further comprising:

applying one or more odorant control substances to one or more layers of the fabric product, wherein the one or more odorant control substances are configured to reduce emission of one or more smells by the fabric product.

3. The fabric product of claim 1, further comprising:

employing one or more dispersal agents that are configured to control one or more of a concentration or a gradient of the one or more photosensitizers applied to the one or more outer surfaces of the fabric product.

4. The fabric product of claim 1, further comprising:

employing one or more dispersal agents that are configured to control one or more of a concentration or a gradient for the one or more coloring substances applied to the one or more of the outer surfaces or the inner surfaces of the fabric product.

5. The fabric product of claim 1, further comprising:

applying one or more phase change substances to the fabric product that are configured to cause another protective barrier for the user of the fabric product; and applying the one or more photosensitizers to one or more inner surfaces of the fabric product.

6. The fabric product of claim 1, further comprising:

applying one or more liquid repellent substances to the fabric product that are configured to cause another protective barrier that is arranged to prevent one or more externally applied liquids from being in contact with the user of the fabric product.

7. The fabric product of claim 1, further comprising:

employing one or more wicking materials as an inner surface of the fabric product that is configured to wick sweat away from the user of the fabric product.

8. The fabric product of claim 1, wherein the fabric product, further comprises:

applying one or more of an activated charcoal substance or a carbon substance to the one or more outer surfaces of the fabric product.

9. The fabric product of claim 1, further comprises:

configuring the fabric product to be arranged as one or more of a garment, headwear, footwear, gloves, a helmet, a hat, a gown, a jacket, a shirt, a pair of pants, a scarf, a cowl, a face mask, a face cover, or a bandage.

10. The fabric product of claim 1, further comprises:

configuring the fabric product to be arranged as one or more of a curtain, a drape, or a covering for a medical device.

* * * * *